US006587120B2

(12) United States Patent
Kasai et al.

(10) Patent No.: US 6,587,120 B2
(45) **Date of Patent: *Jul. 1, 2003**

(54) LIQUID CRYSTAL DISPLAY SYSTEM CAPABLE OF REDUCING AND ENLARGING RESOLUTION OF INPUT DISPLAY DATA

(75) Inventors: Naruhiko Kasai, Fujisawa (JP); Toshio Tanaka, Yokohama (JP); Hiroyuki Mano, Chigasaki (JP); Shigeyuki Nishitani, Ebina (JP); Mitsutoshi Uchida, Hadano (JP); Kazuko Hasegawa, Hiratsuka (JP); Tetsuya Suzuki, Chigasaki (JP); Shinji Wakisaka, Yokohama (JP); Hiroko Sato, Yokohama (JP); Tatsuzo Hamada, Hadano (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/924,583

(22) Filed: Aug. 9, 2001

(65) Prior Publication Data

US 2001/0048418 A1 Dec. 6, 2001

Related U.S. Application Data

(63) Continuation of application No. 09/614,910, filed on Jul. 12, 2000, now Pat. No. 6,310,602, which is a continuation of application No. 08/315,714, filed on Sep. 30, 1994, now Pat. No. 6,118,429.

(30) Foreign Application Priority Data

Sep. 30, 1993 (JP) ..... 5-245205
Oct. 7, 1993 (JP) ..... 5-251363

(51) Int. Cl.[7] ..... G09G 3/18

(52) U.S. Cl. ..... 345/698; 345/667; 345/472; 345/88

(58) Field of Search ..... 345/3.1, 87, 3.2, 345/88, 3.3, 698, 472, 472.1, 472.2, 668–671, 673, 660; 348/392, 424, 448, 458

(56) References Cited

U.S. PATENT DOCUMENTS

| | | | | |
|---|---|---|---|---|
| 2,921,124 | A | 1/1960 | Graham | 348/424 |
| 4,528,693 | A | 7/1985 | Pearson et al. | 345/127 |
| 4,571,584 | A | 2/1986 | Suzuki | 345/94 |
| 4,746,981 | A | 5/1988 | Nadan et al. | 345/1 |
| 4,777,602 | A | 10/1988 | Wesner | 701/224 |
| 4,866,519 | A | 9/1989 | Lucas et al. | 348/448 |
| 4,998,100 | A | 3/1991 | Ishii | 345/3 |
| 5,059,963 | A | 10/1991 | Fukuoka | 345/149 |
| 5,107,255 | A | 4/1992 | Shiraishi | 345/131 |

(List continued on next page.)

FOREIGN PATENT DOCUMENTS

| | | | | |
|---|---|---|---|---|
| EP | 0782333 | * | 7/1997 | H04N/7/01 |
| JP | 57-115593 | | 7/1982 | |
| JP | 3-236097 | | 10/1991 | |
| JP | 5-35214 | | 2/1993 | |

*Primary Examiner*—Lun-Yi Lao
(74) *Attorney, Agent, or Firm*—Antonelli, Terry, Stout & Kraus, LLP

(57) ABSTRACT

A liquid crystal display system which can accept input display data having a resolution which is larger (e.g. 1120×780 dots) or smaller (e.g. 640×480 dots) than a resolution of a liquid crystal panel (e.g. 1024×768 dots), and convert the input display data to reduced or enlarged display data for display on the liquid crystal panel. The system generates, for example, one new vertical or horizontal line based on two contiguous vertical or horizontal lines in the input display data. If the resolution of the input display data is larger than the resolution of the liquid crystal panel, the system replaces the two contiguous lines with the one new line. If the resolution of the input display data is smaller than the resolution of the liquid crystal panel, the system inserts the one new line between the two contiguous lines.

6 Claims, 27 Drawing Sheets

U.S. PATENT DOCUMENTS 5,111,190 A * 5/1992 Zenda ..... 340/717
5,184,218 A 2/1993 Gerdes ..... 348/424
5,185,817 A 2/1993 Degi et al. ..... 345/132
5,194,937 A 3/1993 Lee et al. ..... 358/11
5,267,045 A 11/1993 Stroomer ..... 348/441
5,272,468 A 12/1993 Read ..... 345/153
5,272,471 A 12/1993 Asada et al. ..... 345/3
5,285,192 A 2/1994 Johary et al. ..... 345/132
5,379,057 A 1/1995 Clough et al. ..... 345/173
5,381,182 A 1/1995 Miller et al. ..... 348/448
5,475,808 A 12/1995 Kobayashi ..... 345/132
5,502,808 A * 3/1996 Goddard et al. ..... 345/185
5,515,068 A 5/1996 Uragami et al. ..... 345/3
5,534,883 A 7/1996 Koh ..... 345/3
5,592,194 A 1/1997 Nishikawa ..... 345/132
5,612,714 A * 3/1997 Souviron ..... 345/127
5,742,261 A * 4/1998 Yuki et al. ..... 345/3
6,118,429 A 9/2000 Kasai et al. ..... 345/667
6,310,602 B1 10/2001 Kasai et al. ..... 345/698

* cited by examiner

LIQUID CRYSTAL DISPLAY SYSTEM CAPABLE OF REDUCING AND ENLARGING RESOLUTION OF INPUT DISPLAY DATA

CROSS-REFERENCE TO RELATED APPLICATIONS

This application is a continuation of application Ser. No. 09/614,910 filed on Jul. 12, 2000, now U.S. Pat. No. 6,310,602, which is a continuation of application Ser. No. 08/315,714 filed on Sep. 30, 1994, now U.S. Pat. No. 6,118,429. The contents of application Ser. Nos. 09/614,910 and 08/315,714 are hereby incorporated herein by reference in their entirety.

BACKGROUND OF THE INVENTION

1. Field of the Invention

This invention relates to a display system for use when display data output by a computer differs in resolution from a liquid crystal display screen, which is to display the display data, used as a display for a personal computer, etc.

2. Description of the Related Art

A conventional liquid crystal display receives an interface signal containing display data and a timing signal output by a computer, converts the interface signal into a drive signal for the liquid crystal display, and feeds the drive signal into a liquid crystal drive means. The liquid crystal drive means converts the display data contained in the drive signal into a liquid crystal drive voltage corresponding to the display data and outputs the voltage to a liquid crystal panel. When receiving the liquid crystal drive voltage, the liquid crystal panel displays an image. If the input interface signal differs from the liquid crystal panel in resolution, for example, if the resolution of the input interface signal is larger than that of the liquid crystal panel, a part of the display data contained in the input interface signal is deleted to match the resolution of the interface signal with that of the liquid crystal panel, as described in Japanese Patent Laid-Open No. 57-115593. In the conventional example, the display object is limited to characters and space dots around a character are deleted for each kind of character. The part to be deleted needs to be specified for each kind of character.

The conventional example applies to characters and is not intended for displaying data other than characters.

SUMMARY OF THE INVENTION

It is therefore an object of the invention to provide a liquid crystal display system which can accept an interface signal having a resolution different from that of the liquid crystal display for displaying the display data contained in the interface signal regardless of the type of display data.

To this end, according to one aspect of the invention, there is provided a method of converting first display data in a raster scan format having a first resolution received from an external system into second display data for a liquid crystal display having a second resolution different from the first resolution, the method comprising the steps of:

a) generating data for n vertical or horizontal lines based on specific m vertical or horizontal lines contiguous to each other of the first display data, where m is an integer of two or greater and n is an integer less than m;

b) repeating at least one of the following steps c) and d) as many times as required in sequence at different positions on a screen of the liquid crystal display;

c) replacing k ($n<k\leqq m$) lines of the m vertical or horizontal lines with the n vertical or horizontal lines; and d) adding the n vertical or horizontal lines to the m vertical or horizontal lines.

The data conversion means converts display data received from a personal computer or the like into display data using gray scale data so that it matches the resolution of the liquid crystal display. Thus, even display data output by the personal computer or the like assuming an output device having resolution different from that of the liquid crystal display can be displayed on the liquid crystal display.

According to another aspect of the invention, there is provided a method of converting first display data in a raster scan format having a first horizontal resolution received from an external system into second display data for a liquid crystal display having a second horizontal resolution smaller than the first horizontal resolution, the method comprising the steps of:

a) virtually dividing a set of M contiguous dots on a horizontal line into N equal partitions, where M is an integer of three or greater and N is an integer of two or more, less than M;

b) repeating, N times with respect to the N equal partitions, a weighted addition of data values of dots contained in one partition, depending upon what percentage of the partition is occupied by each dot in the partition;

c) replacing the M dots with n dots which have the data values of the N partitions resulting from the weighted additions in step b);

d) repeating steps a) to c) for different sets of M contiguous dots in sequence at least in a part of one horizontal line; and e) repeating step d) for different horizontal lines in sequence.

According to still another aspect of the invention, there is provided a method of converting first display data in a raster scan format having first horizontal resolution received from an external system into second display data for a liquid crystal display having second horizontal resolution larger than the first horizontal resolution, the method comprising the steps of:

a) virtually dividing a set of M contiguous dots on a horizontal line into N equal partitions, where M is an integer of two or greater and N is an integer of three or more which is greater than M;

b) repeating, N times with respect to the N equal partitions, a weighted addition of one or more data values of dots contained in one partition, depending upon what percentage of each dot contributes in the partition;

c) replacing the M dots with N dots which have the data values of the N partitions resulting from the weighted additions in step b);

d) repeating steps a) to c) for different sets of M contiguous dots in sequence at least in a part of one horizontal line; and e) repeating step d) for different horizontal lines in sequence.

DESCRIPTION OF THE PREFERRED EMBODIMENTS

Preferred embodiments of the invention will now be described with reference to the accompanying drawings.

A first embodiment of a personal computer system to which a liquid crystal display system of the invention is connected will be discussed with reference to FIGS. 1 to 4, 5A–5B, and 6 to 16.

Figure 1:
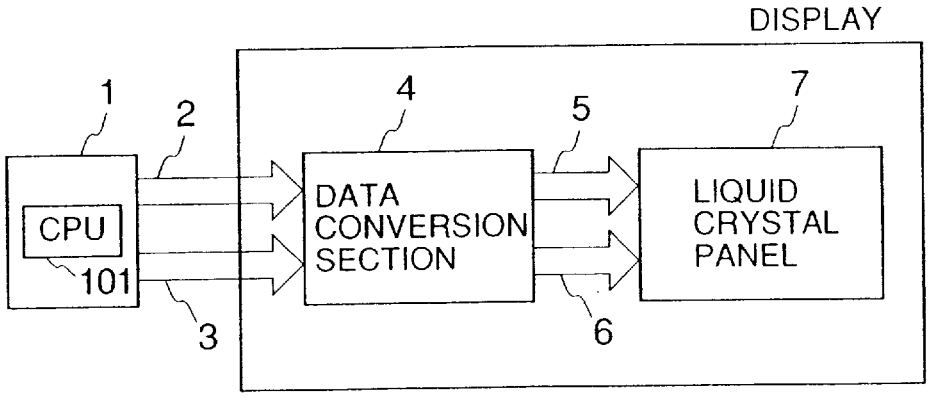
FIG. 1 is a block diagram of a system to which the invention is applied.

FIG. 1 is a block diagram of a personal computer system to which the invention is applied. In the figure, numeral 1 indicates a personal computer or workstation (PC) which contains a central processing unit (CPU) 101, etc., numeral 2 indicates display data, numeral 3 indicates a timing signal, numeral 4 indicates a data conversion section for converting display data of the PC 1 into a liquid crystal drive signal, numeral 5 indicates liquid crystal display data, numeral 6 indicates a liquid crystal display timing signal, and numeral 7 indicates a liquid crystal panel. The data conversion section 4 and the liquid crystal panel 7 make up a liquid crystal display unit. The data conversion section 4 converts the display data 2 input from the PC 1 into the liquid crystal b display data 5 enlarged or reduced in accordance with the resolution of the liquid crystal panel 7 and generates the liquid crystal display timing signal 6. The liquid crystal display data 5 and the liquid crystal display timing signal 6 are collectively called a liquid crystal drive signal. The display data is converted into a liquid crystal drive voltage at the liquid crystal panel 7. In the description to follow, assume that the display data 2 has 4-bit gradation data for each of the primary colors red (R), green (G), and blue (B) and is transferred in series in synchronization with the timing signal 3. For simplicity, assume that the liquid crystal panel 7 consists of pixels of 1024×768 dots and that the PC 1 outputs a timing signal and display data of 1120×780 dots, which will be hereinafter referred to as display mode 1 throughout the specification, or 640×480 dots, which will be hereinafter referred to as display mode 2 throughout the specification, in response to the display mode.

Figure 2:
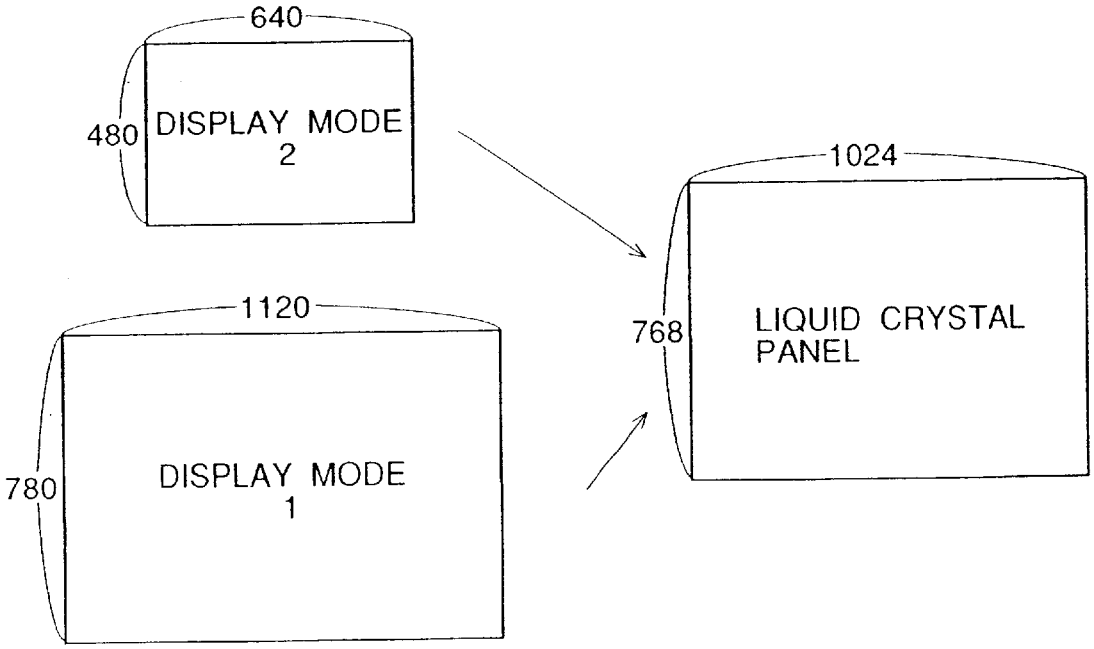
FIG. 2 is an illustration showing resolutions to which the invention may be applied.

FIG. 2 shows the display modes of the invention. The data conversion section 4 discriminates between the display modes 1 and 2 and executes reduction processes in display mode 1 and enlargement processes in display mode 2 in response to the display mode.

Also, assume that the number of colors that can be displayed on the liquid crystal panel 7 is 4096 and that the PC 1 performs so-called raster scanning in which with each pixel represented by 4-bit attribute data (gradation data) for each of R (red), G (green), and B (blue), the data is output for one pixel at a time in sequence from left to right in the horizontal line direction and the operation is repeated in sequence as many times as the number of the horizontal lines from top to bottom.

Some operation examples of the data conversion section 4 will be discussed in the first embodiment.

As the first operation example, a gray scale line replacement/insertion system will be described with reference to FIG. 3.

Figure 3:
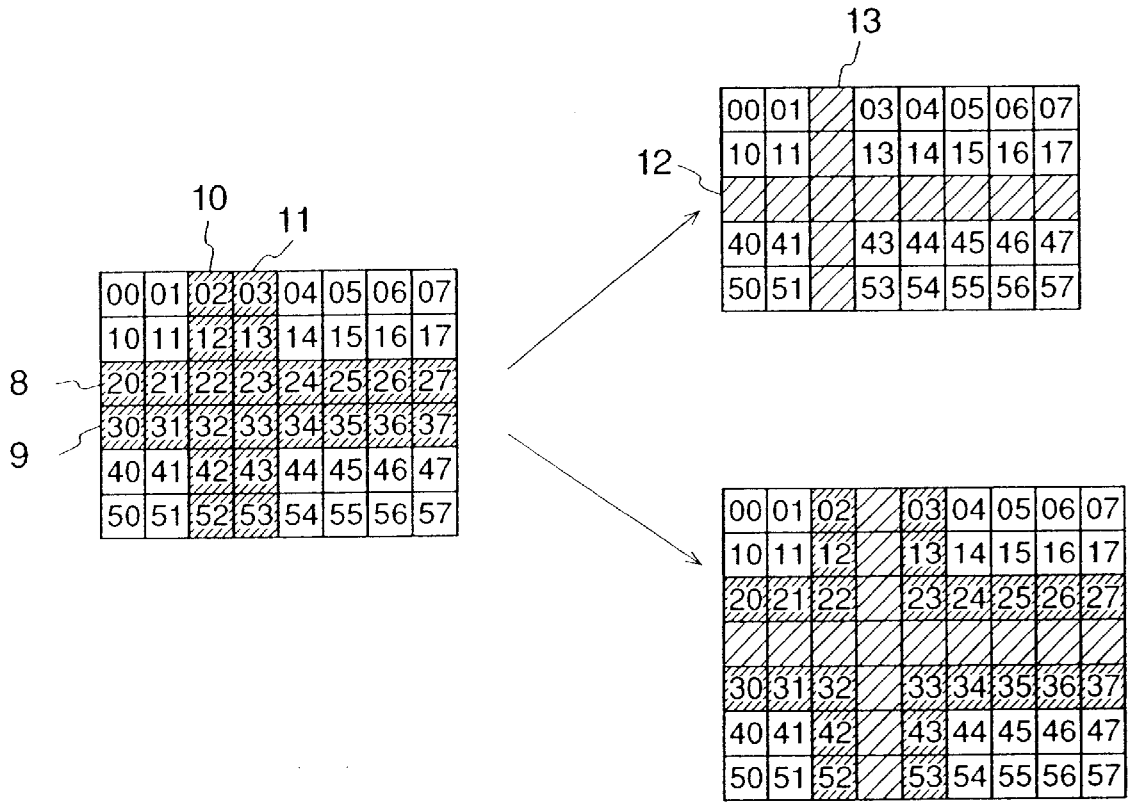
FIG. 3 is an illustration of reduction and enlargement by gray scale line replacement and insertion according to the invention.

FIG. 3 shows gray scale line replacement in display mode 1 and insertion in display mode 2, wherein numerals 8 and indicate first and second horizontal extraction lines representing horizontal replacement or insertion positions, numerals 10 and 11 indicate first and second vertical extraction lines representing vertical replacement or insertion positions, numeral 12 indicates a horizontal gray scale line resulting from calculating the gray scale for the first and second horizontal extraction lines 8 and 9, and numeral 13 indicates a vertical gray scale line resulting from calculating the gray scale for the first and second vertical extraction lines 10 and 11. In display mode 1, horizontal and vertical gray scale lines are prepared from first and second horizontal and vertical extraction lines and the first and second horizontal extraction lines 8 and 9 are replaced with the horizontal gray scale line 12 and the first and second vertical extraction lines 10 and 11 are replaced with the vertical gray scale line 13, thereby performing reduction processing. In display mode 2, a horizontal gray scale line is inserted between the horizontal extraction lines 8 and 9 and a vertical gray scale line is inserted between the vertical extraction lines 10 and 11, thereby performing enlargement processing.

The extraction line positions may be equally spaced as desired, or lines with less display data may be found and selected to be extraction lines.

Figure 4:
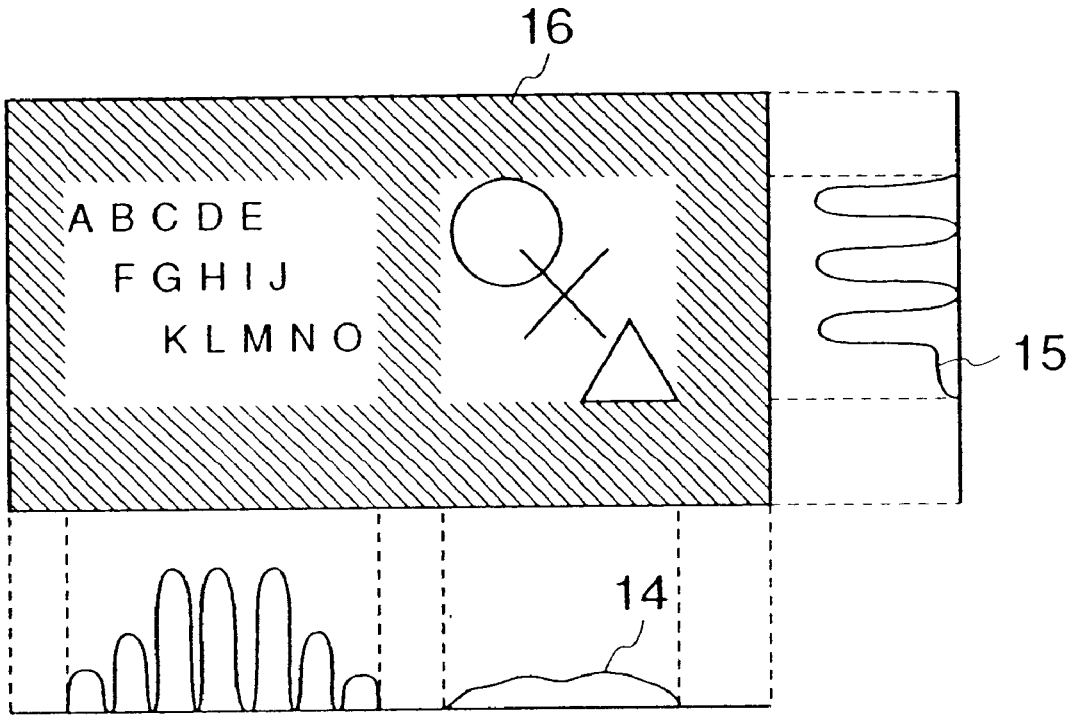
FIG. 4 is an illustration of a method for detecting an area with less display data.

FIG. 4 shows a method of determining the position of a horizontal or vertical extraction line where replacement or insertion is to be made from the display data amount. In the figure, numeral 14 indicates the summation result of the number of pixels displayed in a color different from the background color for each vertical line, numeral 15 indicates the summation result of the number of pixels displayed in a color different from the background color for each horizontal line, and numeral 16 indicates a hatched area containing the positions of horizontal or vertical lines where insertion or deletion can be made, determined from the summation results 14 and 15. In the example, positions having the smallest amount of display data possible are found for replacement or insertion positions.

Further, for a screen with windows displayed, an area outside the window regions may be detected for replacement or insertion positions.

Figure 5A:
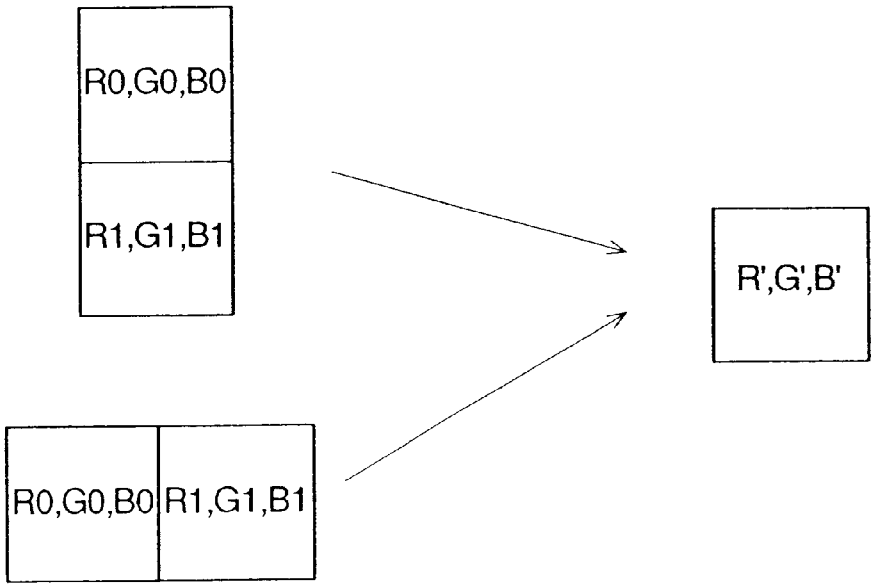
FIGS. 5A and 5B are illustrations of gray scale pixel calculation methods.
Figure 5B:
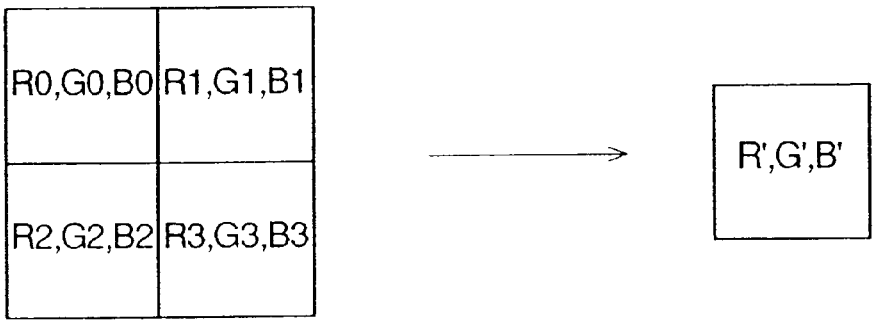

FIGS. 5A and 5B show a gray scale pixel calculation method.

For example, to prepare a gray scale pixel from two pixels shown in FIG. 5A, the average values of the attributes for R, G, and B may be calculated:

$$R'=(R0+R1)/2$$
$$G'=(G0+G1)/2 \qquad \text{Expression 1}$$
$$B'=(B0+B1)/2$$

This calculation can be repeated as many times as the number of pixels making up one line for calculating a gray scale line. Further, to calculate the gray scale from a number of pixels as shown in FIG. 5B, such as at the intersection of horizontal and vertical lines, the average of the attributes for the four pixels $$R'=(R0+R1+R2+R3)/4$$
$$G'=(G0+G1+G2+G3)/4 \qquad \text{Expression 2}$$
$$B'=(B0+B1+B2+B3)/4$$

may be used as gray scale pixel data.

When the average values are calculated, fractional digits may occur. It is desirable to handle the fractional digits so that a color different from the background color is output in response to the attribute of the background color. For example, if the background is black (R=0000, G=0000, B=0000), when the average values of R, G, and B are calculated, fractions are rounded up or rounded off, and if the background is white (R=1111, G=1111, B=1111), fractions are rounded down, whereby a color different from the background color can be displayed. If the background color has different attributes for R, G, and B, such as blue (R=0000, G=0000, B=1111), fractions are rounded up when gradation of R or G is calculated, or fractions are rounded down when gradation of B is calculated.

Further, another system in which the number of extraction lines in the reduction process is three will be discussed with reference to FIG. 6. Here, the processing is described by taking only horizontal lines as an example and similar processing is also performed for the vertical lines.

Figure 6:
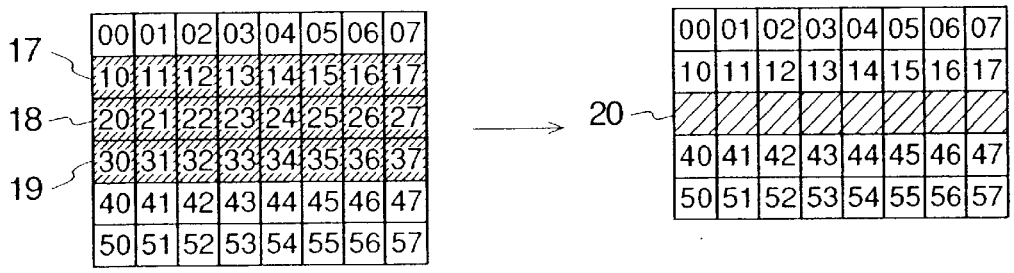
FIG. 6 is an illustration of replacement with a gray scale line using three extraction lines.

In FIG. 6, numerals 17, 18, and 19 indicate first, second, and third extraction lines and numeral 20 indicates a gray scale line found from the average of the display data for the three lines. The second extraction line 18 is replaced with the gray scale data line 20 and the third extraction line 19 is deleted, thereby performing the reduction process. Since similar processing is also performed in the vertical direction, the average of 9-pixel display data may be calculated for the intersection of the extraction lines. The way to find the gray scale data is similar to that in the first operation example.

Next, an example of the hardware configuration of the data conversion section 4 for carrying out the first operation example will be discussed with reference to FIGS. 7 and 8.

Figure 7:
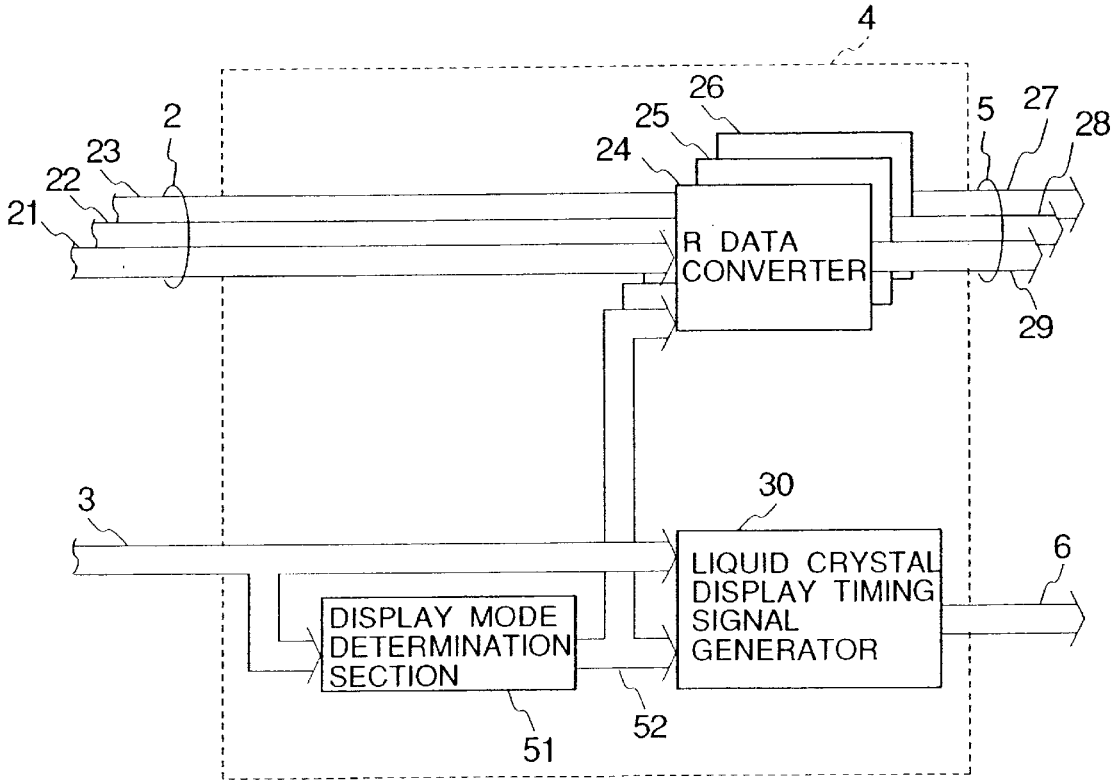
FIG. 7 is a block diagram showing the configuration of the data conversion section shown in FIG. 1.

FIG. 7 is an example of the configuration of the data conversion section 4, wherein numerals 21, 22, and 23 indicate R display data, G display data, and B display data of the display data 2 respectively, numeral 24 indicates an R data converter, numeral 25 indicates a G data converter, numeral 26 indicates a B data converter, numeral 27 indicates B liquid crystal display data, numeral 28 indicates G liquid crystal display data, numeral 29 indicates R liquid crystal display data, numeral 51 indicates a display mode determination section, numeral 52 indicates a display mode signal, numeral 30 indicates a liquid crystal display timing signal generator, and numeral 6 indicates a liquid crystal display timing signal. The display mode determination section 51 determines the display mode from the timing signal 3 and outputs the display mode signal 52. The data converters 24, 25, and 26 process the R, G, and B display data 21, 22, and 23 respectively in accordance with the resolution represented by the display mode signal 52. The liquid crystal display timing signal generator 30 generates the liquid crystal display timing signal 6 matched with the output resolution represented by the display mode signal 52 from the timing signal 3.

Figure 11:
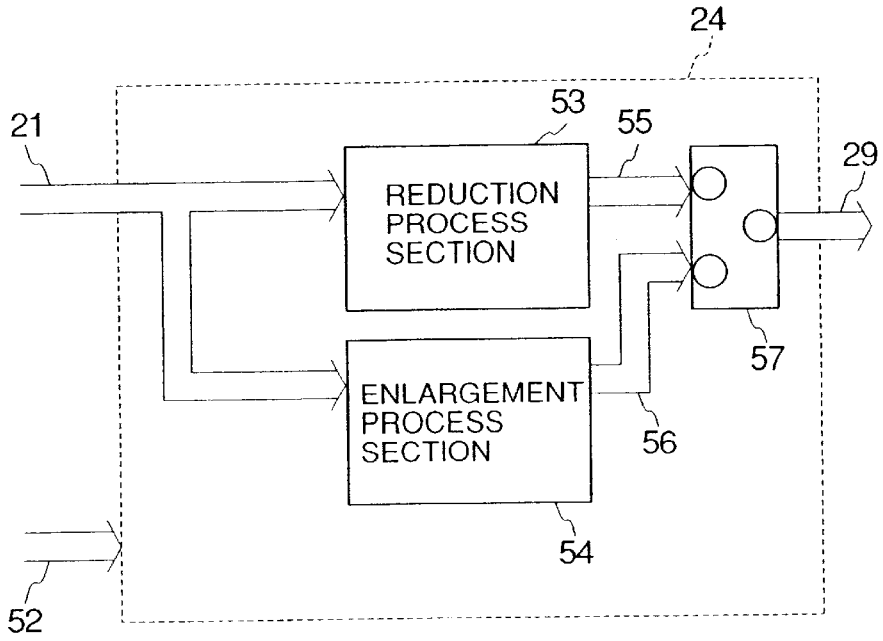
FIG. 11 is a block diagram showing the configuration of the R data converter shown in FIG. 7.

FIG. 11 is an example of the configuration of the R data converter 24. The G and B data converters 25 and 26 also each have the same configuration as the R data converter 24. In FIG. 11, numeral 53 indicates a reduction process section, numeral 54 indicates an enlargement process section, numeral 55 indicates reduced display data, numeral 56 indicates enlarged display data, and numeral 57 indicates resolution switch means. When the display mode signal 52 represents the display mode 1, the reduction process section 53 converts the R display data 21 into the reduced display data 55; at that time, the enlargement process section 54 does not operate. When the display mode signal 52 represents the display mode 2, the enlargement process section 54 converts the R display data 21 into the enlarged display data 56; at that time, the reduction process section 53 does not operate. The resolution switch means 57 is responsive to the display mode signal 52 for outputting the reduced display data 55 when the display mode signal 52 represents the display mode 1 or the enlarged display data 56 when the display mode signal 52 represents the display mode 2 as the R liquid crystal display data 29. Although the reduction process section 53 and the enlargement process section 54 are provided to support two display modes in the embodiment, additional reduction or enlargement process sections can also be provided for supporting other resolutions.

Figure 8:
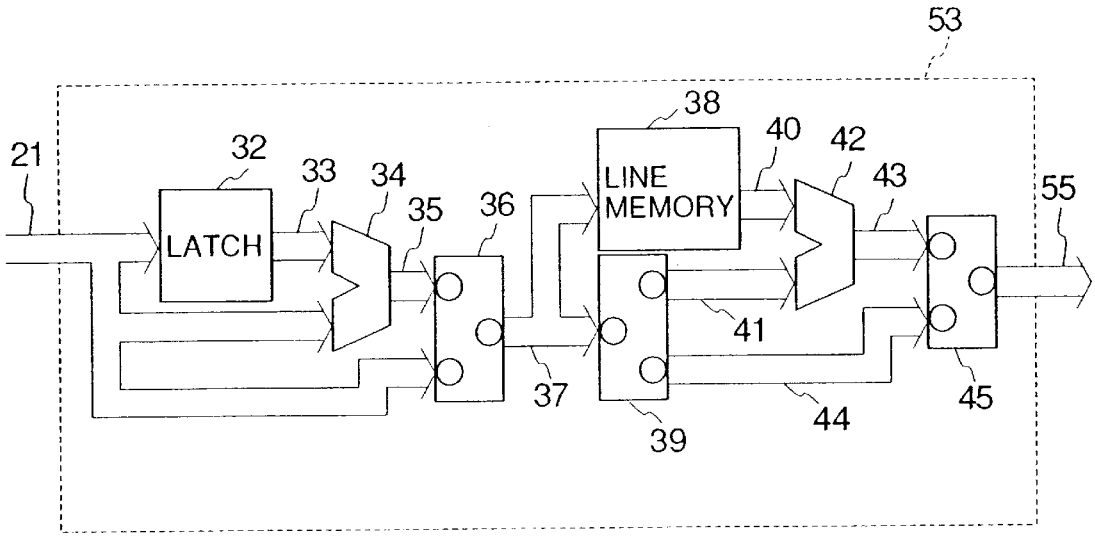
FIG. 8 is a block diagram showing the configuration of a reduction process section shown in FIG. 11.

FIG. 8 is one example of the configuration of the reduction process section 53. Hereinafter, a horizontal row of dots of display data will be referred to as a line. This means that the liquid crystal panel 7 used in the invention consists of 1024 dots×768 lines.

In FIG. 8, numeral 32 indicates a latch, numeral 33 indicates preceding dot data, numeral 34 indicates a horizontal operation section, numeral 35 indicates horizontal gray scale data, numeral 36 indicates a horizontal selector, numeral 37 indicates horizontal data, numeral 38 indicates a line memory, numeral 39 indicates a vertical selector, numeral 40 indicates preceding line data, numeral 41 indicates operational horizontal data, numeral 42 indicates a vertical operation section, numeral 43 indicates vertical gray scale data, numeral 44 indicates output horizontal data, and numeral 45 indicates an output selector. The latch 32, which latches the R display data 21 in synchronization with a dot clock (not shown) provided by the timing signal 3, outputs the preceding dot data 33 which is display data one dot before the R display data 21. The horizontal operation section 34 performs an operation on the preceding dot data 33 and the R display data 21 (averaging them) and outputs the horizontal gray scale data 35. The horizontal selector 36 selects either the horizontal gray scale data 35 or the R display data 21 depending on which position of the liquid crystal panel 7 the R display data 21 is at, and outputs the data 35 or 21 as the horizontal data 37, as described below in detail. The line memory 38 stores one line of the horizontal data 37 and outputs it as the preceding line data 40 which is data one line before when the display data of the next line is input. The vertical selector 39 outputs the horizontal data 37 to either the vertical operation section 42 as the operational horizontal data 41 or the output selector 45 as the output horizontal data 44 depending on which position of the liquid crystal panel 7 the horizontal data 37 is at, as described below in detail. The vertical operation section 42 performs an operation on the preceding line data 40 and the operational horizontal data 41 and outputs the result as the vertical gray scale data 43. The output selector 45 outputs either the vertical gray scale data 43 or the output horizontal data 44 depending on which position of the liquid crystal panel 7 the R display data 21 is at, as with the R liquid crystal display data 29, as described below in detail.

Figure 12:
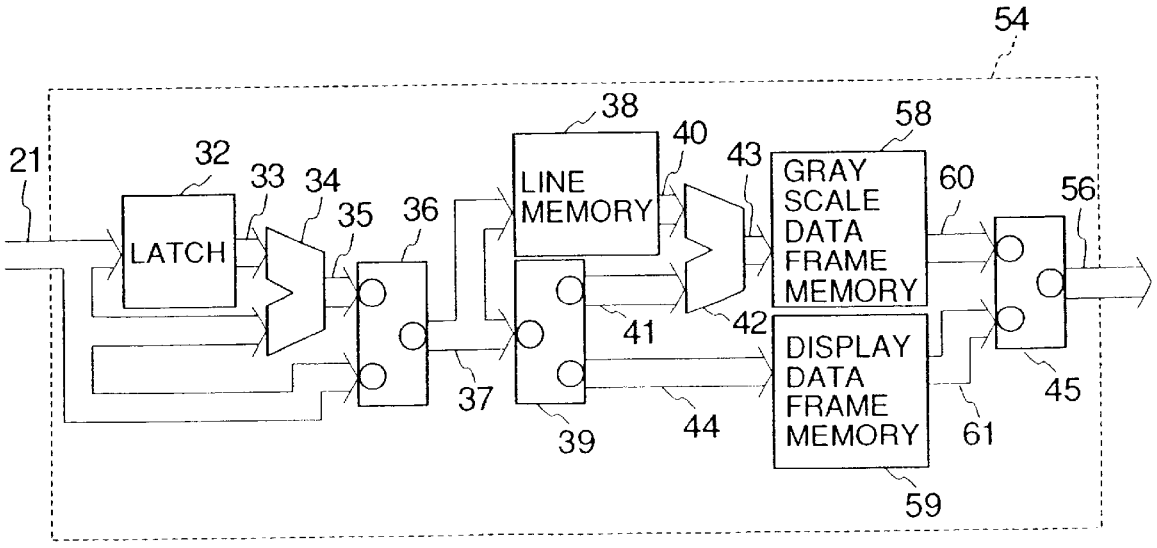
FIG. 12 is a block diagram showing the configuration of the enlargement process section shown in FIG. 11.

FIG. 12 is an example of the configuration of the enlargement process section 54, wherein numeral 58 indicates a gray scale data frame memory, numeral 59 indicates a display data frame memory, numeral 60 indicates gray scale read data, and numeral 61 indicates display read data. Other components identical with those of the reduction process section 53 previously described with reference to FIG. 8 are denoted by the same reference numerals in FIG. 12. In FIG. 12, a latch 32 and a horizontal operation section 34 operate like those of the reduction process section 53. If R display data 21 is data on a first vertical extraction line, a horizontal selector 36 outputs the R display data 21, then outputs gray scale horizontal data 35 for inserting a vertical line before R display data 21 for the next dot comes. A line memory 38, a vertical selector 39, and a vertical operation section 42 operate like those of the reduction process section 53. Vertical gray scale data 43 for one screen (frame) is stored in the gray scale data frame memory 58 and output horizontal data 44 for one screen (frame) is stored in the display data frame memory 59. When display data of the next screen (frame) is input, the vertical gray scale read data 60 is read and inserted into any position between the display read data 61 for inserting a horizontal line.

Next, the operation related to the reduction process by gray scale replacement will be discussed in detail with reference to FIGS. 1, 7, 8, and 11.

In FIG. 1, the data conversion section 4 converts the display data 2 and the timing signal 3 into the liquid display data 5 and the liquid crystal display timing signal 6 matched with the liquid crystal panel 7 for output. In FIG. 7, the display mode determination section 51 determines the display mode from the timing signal 3 and the display mode signal 52 matched with the resolution of the liquid crystal panel 7 for display. The display mode can be determined by counting the number of clocks of the timing signal 3 or by feeding the display mode signal 52 from an external system without providing the display mode determination section 51. R, G, and B of the display data 2 are input to the R, C, and B data converters 24, 25, and 26 respectively, which then convert the data into the liquid crystal display data 5 matched with the display mode represented by the display mode signal 52. The liquid crystal display timing signal generator 30 generates the liquid crystal display timing signal 6 matched with the display mode represented by the display mode signal 52 from the timing signal 3.

The operation of the R data converter 24 for display data conversion will be discussed in detail with reference to FIG. 11. Each of the G and B data converters 25 and 26 (Q performs an operation similar to that of the R data converter 24.

In FIG. 11, when the display mode signal 52 represents the display mode 1, the reduction process section 53 operates and generates the reduced display data 55. When the display mode signal 52 represents the display mode 2, the enlargement process section 54 operates and generates the enlarged display data 56. The resolution switch means 57 is responsive to the display mode signal 52 for selecting and outputting the reduced display data 55 in the display mode 1 or the enlarged display data 56 in the display mode 2. As described above, additional reduction and enlargement process sections can be provided to make up a data conversion section which supports other resolutions.

The operation of the reduction process section 53 will be discussed in detail with reference to FIGS. 8, 13, and 14. In FIG. 8, since the latch 32 latches input R display data 21 according to a dot clock, the data output by the latch 32 becomes the preceding dot display data 33 which is the data one dot before the R display data 21. The horizontal operation section 34 performs an operation on the preceding dot display data 33 and the R display data 21 to generate gray scale data, and outputs it as the horizontal gray scale data 35. If the R display data 21 is data on a first vertical extraction line, the horizontal selector 36 outputs neither the horizontal gray scale data 35 nor the R display data 21; if it is data on a second vertical extraction line, the horizontal selector 36 outputs the horizontal gray scale data 35; if it is not data on the first or second vertical extraction line, the horizontal selector 36 outputs the R display data 21 as the horizontal data 37.

The horizontal data 37 for one line is stored in the line memory 38, and is read out when horizontal data 37 for the next line is input. Therefore, the data output by the line memory 38 becomes the preceding line display data 40 which is one line before the horizontal data 37. If the horizontal data 37 is data on a first horizontal extraction line, the vertical selector 39 does not output the data to the vertical operation section 42 or the output selector 45; if it is data on a second horizontal extraction line, the vertical selector 39 outputs the data to the vertical operation section 42 as the operational horizontal data 41; if it is not data on the first or second vertical extraction line, the vertical selector 39 outputs the data to the output selector 45 as the output horizontal data 44. The vertical operation section 42 performs an operation on the preceding line display data 40 and the operational horizontal data 41 to generate gray scale data, and outputs it as the vertical gray scale data 43. If the horizontal data 37 is data on the first horizontal extraction line, the output selector 45 outputs neither the vertical gray scale data 43 nor the output horizontal data 44; if it is data on the second horizontal extraction line, the output selector 45 outputs the vertical gray scale data 43; if it is not data on the first or second horizontal extraction line, the output selector 45 outputs the output horizontal data 44. The reduction process by gray scale replacement shown in FIG. 3 is now complete.

Figure 13:
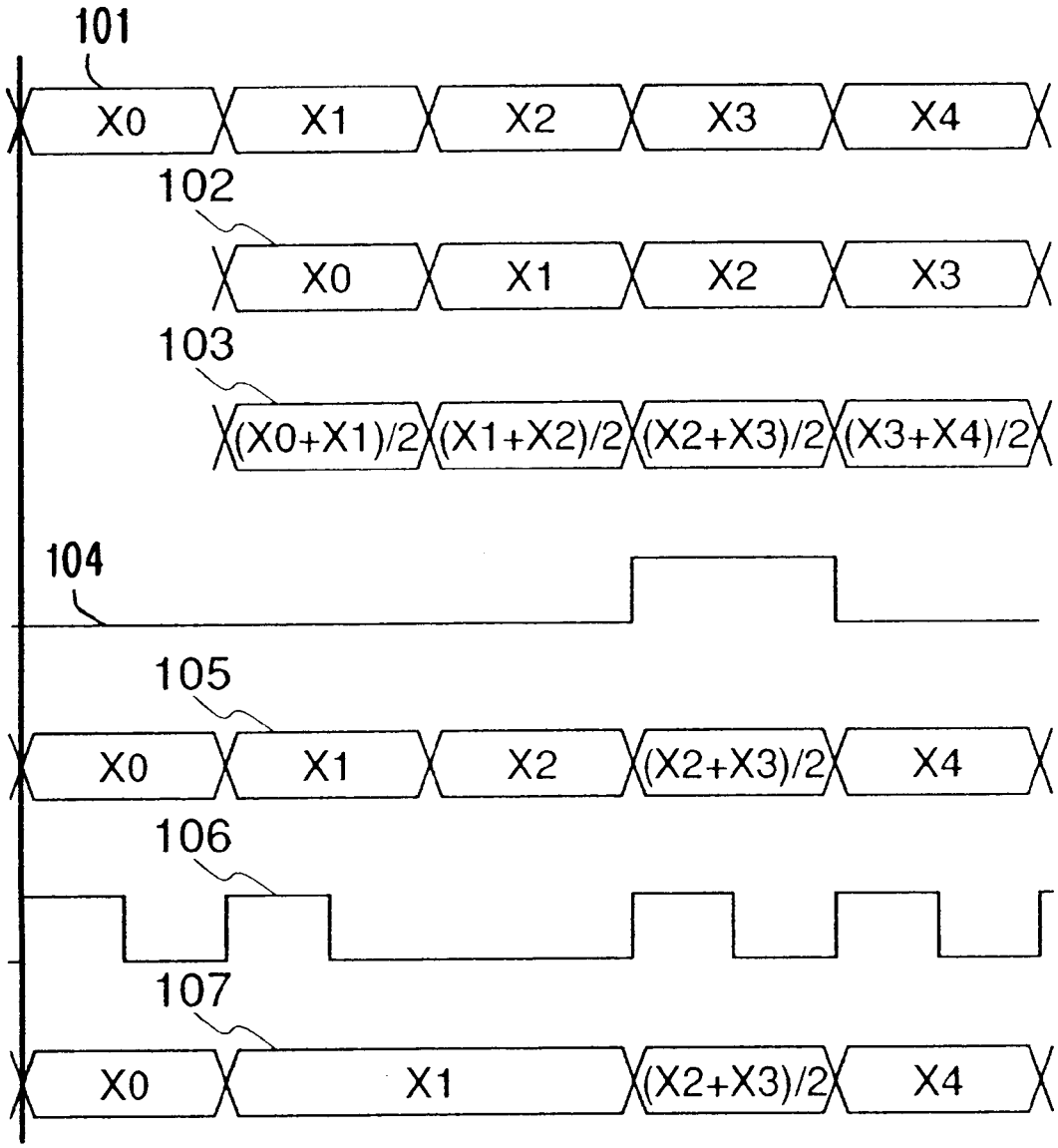
FIG. 13 is an input/output timing chart for a lateral reduction process.

FIG. 13 is an input/output timing chart for the lateral reduction process in the reduction process section 53.

In the figure, numeral 101 indicates the input timing of the R display data 21, numeral 102 indicates the output timing for the preceding dot data 33, and numeral 103 indicates the output timing for the horizontal gray scale data 35, showing that the result of dividing the sum of the R display data 21 and the preceding dot data 33 by two is output as the horizontal gray scale data 35. Numeral 104 indicates the select signal timing of the horizontal selector 36 and numeral 105 indicates the output timing of horizontal data 37, showing that the select signal 104 is set to 1 at the position next to the first vertical extraction line 10 shown in FIG. 3, outputting the horizontal gray scale data 35.

Numeral 106 indicates the timing of a synchronous clock contained in the liquid crystal timing signal 6 and numeral 107 indicates the timing of data displayed on the liquid crystal panel 7. X2 data is deleted by synchronizing the horizontal data timing 105 with the synchronous clock timing 106 for stopping the clock finally corresponding to the position of the first vertical extraction line 10.

Figure 14:
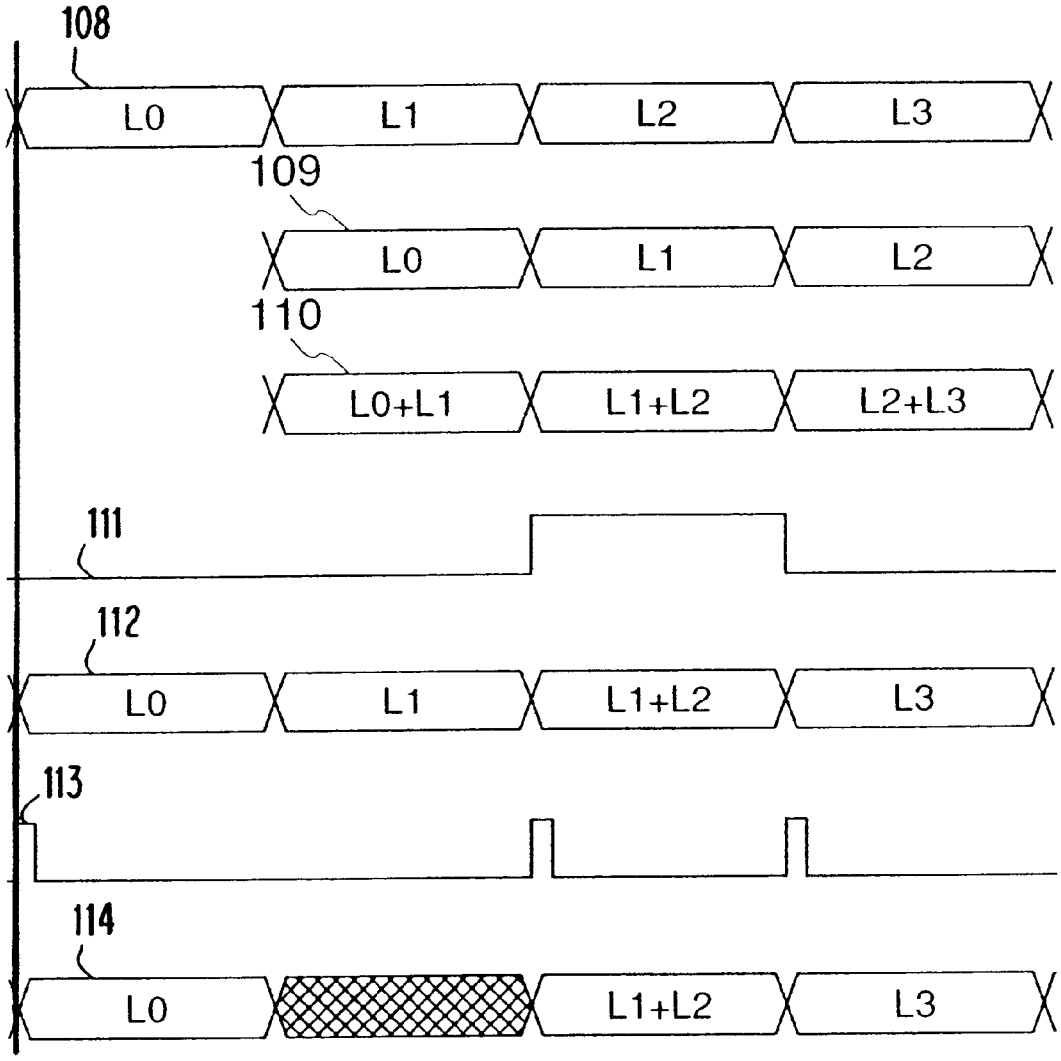
FIG. 14 is an input/output timing chart for a longitudinal reduction process.

FIG. 14 is an input/output timing chart for the longitudinal reduction process of the reduction process section 53.

In the figure, numeral 108 indicates the line output timing for the horizontal data 37, numeral 109 indicates the output timing for the preceding line signal 40 output by the line memory 38, numeral 110 indicates the output timing for the vertical gray scale data 43 generated by performing an operation on the output of the line memory 38 and the horizontal data 37, and numeral 112 indicates the output timing of the reduced display signal 55 output from the output selector 45. L0 and L1 denote data for the first line and data for the second line respectively; L0 and L1 are averaged to generate the vertical gray scale data 43. This also applies to the second line, third line, and later. Numeral 111 indicates a select signal for the output selector 45, which allows the vertical gray scale data 43 to be output on the line next to the first horizontal extraction line 8 shown in FIG. 3. Numeral 112 indicates the output timing of the reduced display signal 55, numeral 113 indicates the output timing of a horizontal synchronizing signal contained in the liquid crystal display timing signal 6, and numeral 114 indicates the timing of display data actually displayed. Although the output timing 112 of the output selector 45 follows the select signal timing 111, L1 is not displayed as shown in 114 because the actual horizontal synchronizing signal is as shown in 113 .

Next, the enlargement process by gray scale insertion will be discussed in detail with reference to FIGS. 12, 15, and 16.

In FIG. 12, the latch 32 and the horizontal operation section 34 operate like those of the reduction process section 53. If R display data 21 is data on a first vertical extraction line, the horizontal selector 36 outputs the R display data 21, then outputs gray scale horizontal data 35 for inserting a vertical line before R display data 21 for the next dot comes. The line memory 38, the vertical selector 39, and the vertical operation section 42 operate like those of the reduction process section 53. Vertical gray scale data 43 for one screen (frame) is stored in the gray scale data frame memory 58 and output horizontal data 44 for one screen (frame) is stored in the display data frame memory 59. When display data for the next screen (frame) is input, the vertical gray scale read data 60 is read and inserted into any position between the display read data 61 for inserting a horizontal line.

Figure 15:
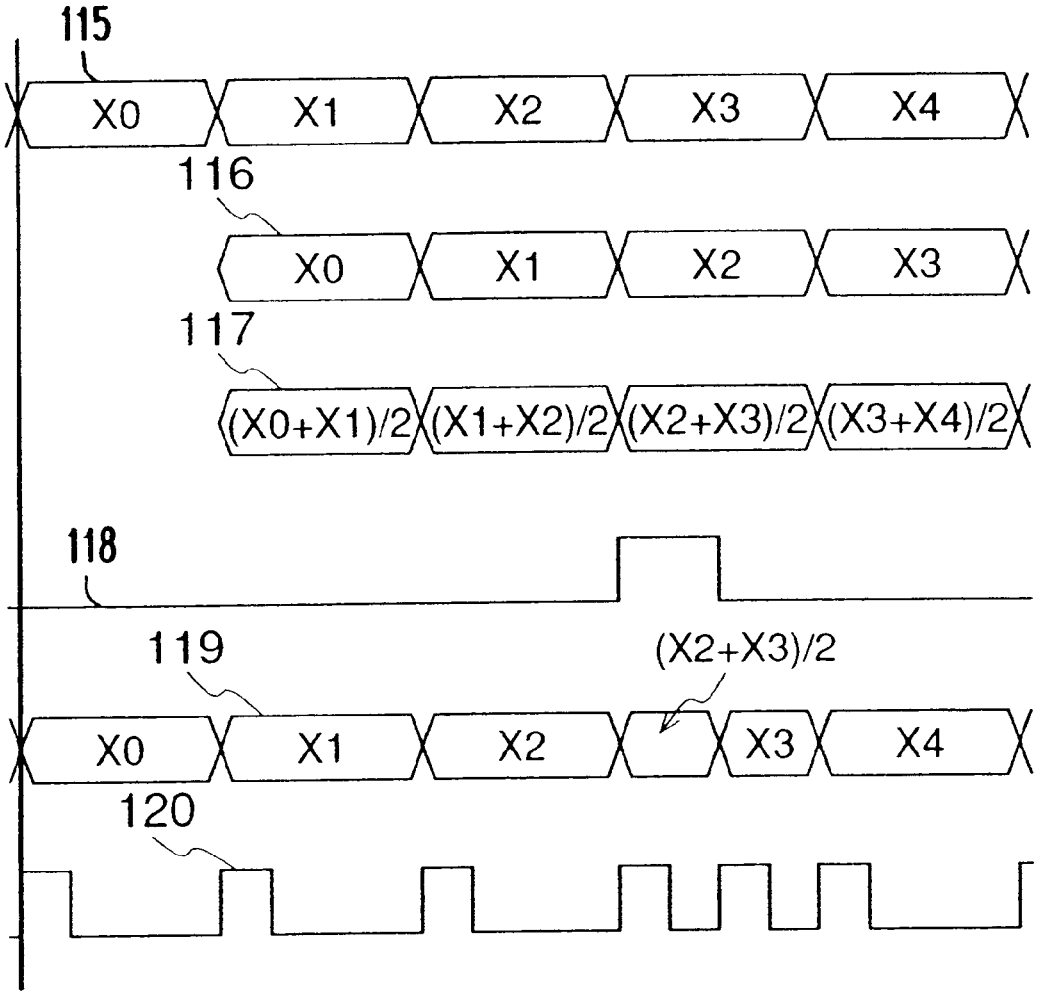
FIG. 15 is an input/output timing chart for a lateral enlargement process.

FIG. 15 is an input/output timing chart of the lateral enlargement process for the enlargement process section 54.

In the figure, numeral 115 indicates the input timing for the R display data 21, numeral 116 indicates the output timing for the preceding dot data 33, and numeral 117 indicates the output timing for the horizontal gray scale data 35, showing that the result of dividing the sum of the R display data 21 and the preceding dot data 33 by two is output as the horizontal gray scale data 35. Numeral 118 indicates the select signal timing for the horizontal selector 36, numeral 119 indicates the output timing for the horizontal data 37, and numeral 120 indicates the timing of a synchronous clock contained in the liquid crystal display timing signal 6, showing that the select signal 104 is set to 1 at the position next to the first vertical extraction line 10 shown in FIG. 3, outputting the horizontal gray scale data 35. The period of only the synchronous clock at the time is doubled and while 1-dot data is input, 2-dot data of the horizontal gray scale data 35 and the R display data 21 is output.

Figure 16:
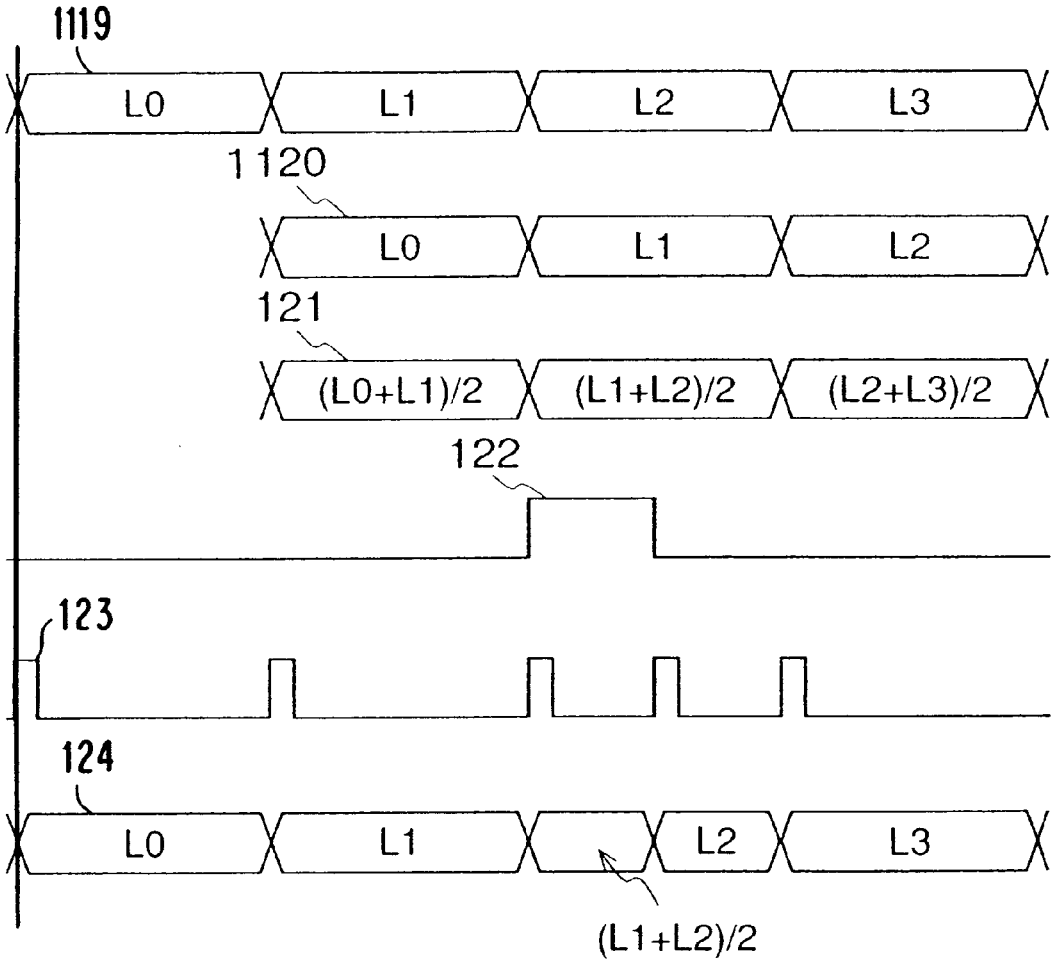
FIG. 16 is an input/output timing chart for a longitudinal enlargement process.

FIG. 16 is an input/output timing chart of the longitudinal enlargement process for the enlargement process section 54.

In the figure, numeral 1119 indicates the output timing for the horizontal data 37 for each line, numeral 1120 indicates the output timing for the preceding line data 40 for each line output from the line memory 38, and numeral 121 indicates the output timing of vertical gray scale data 43 for each line, showing that the vertical gray scale data 43 is the result of dividing by two the sum of the horizontal data 37 and the preceding line data 40 which is the data one line before the horizontal data 37. Numeral 122 indicates a timing signal representing the position into which the vertical gray scale data 43 is inserted, numeral 123 indicates a horizontal synchronizing signal contained in the liquid crystal display timing signal 6, and numeral 124 indicates the timing for each line actually displayed. When the vertical gray scale data is inserted, the vertical gray scale data insertion timing 122 is set to "1" on the line next to the first horizontal extraction line 8. At this time, the period of the synchronous clock is doubled and while 1-line data is input, 2-line data is output. For the first one of these two lines, the vertical gray scale data is selectively output from the gray scale data frame memory 58 and for the second line, the horizontal data is selectively output from the display data frame memory 59.

When a number of insertion lines are equally spaced, for example, when a gray scale data line is to be inserted every n lines, (n+1) line memories are provided for storing gray scale data to be inserted and line data. When the next data is input, the (n+1)-line data containing the gray scale line data is read out while n line data is stored, whereby a horizontal line can be inserted without providing the frame memories.

The data conversion section 4 which performs the processing may be software which uses the CPU 101, hardware, may exist in the PC 1, or may be contained in the liquid crystal pane 7.

As the second operation example of the data conversion section 4, a system of converting horizontal resolution with low-pass filters will be described with reference to FIG. 9.

Figure 9:
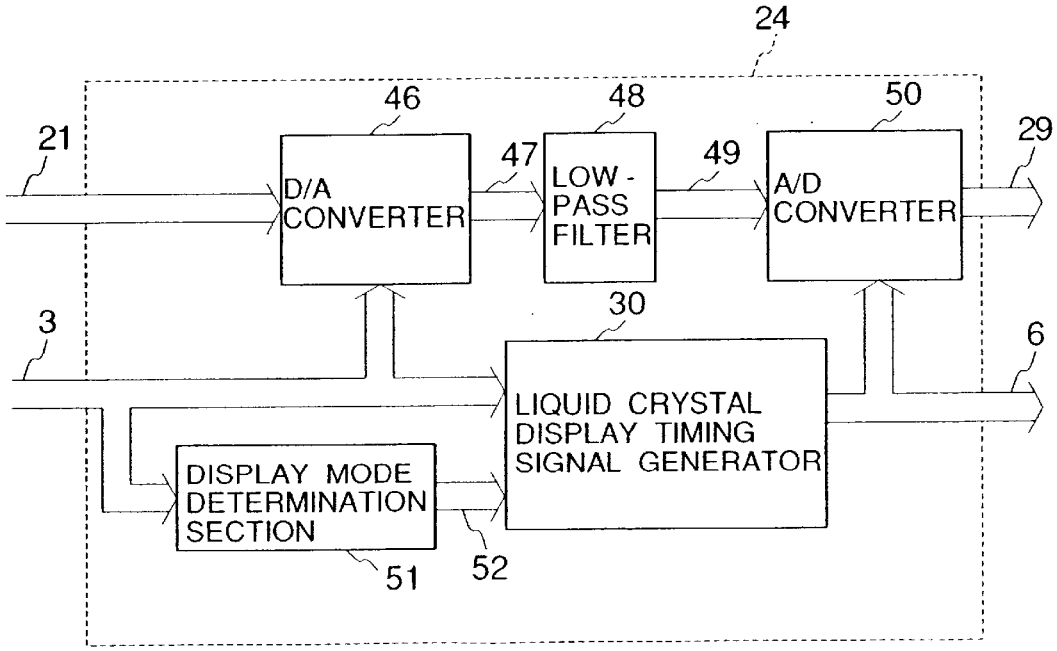
FIG. 9 is a block diagram of a DAD conversion system.

FIG. 9 shows the configuration of an R data converter 24 with a low-pass filter, wherein numeral 46 is a D/A converter, numeral 47 indicates analog R display data, numeral 48 indicates a low-pass filter, numeral 49 indicates smoothed R display data, numeral 50 indicates an A/D converter, and numeral 51 indicates a display mode determination section which performs the same operation as that described above. The D/A converter 46 immediately converts digital output R display data 21 into analog R display data 47 and outputs the analog R display data 47 to the low-pass filter 48 which then smoothes the data 47 to generate the smoothed R display data 49. Lastly, the smoothed R display data is restored to a digital signal by the A/D converter 50 using the liquid crystal display timing signal 6 matched with the resolution of the liquid crystal display. If the liquid crystal display timing signal 6 has a higher frequency than the input timing signal 3, the enlargement process is executed; if the former has lower frequency than the latter, the reduction process is executed.

Figure 10:
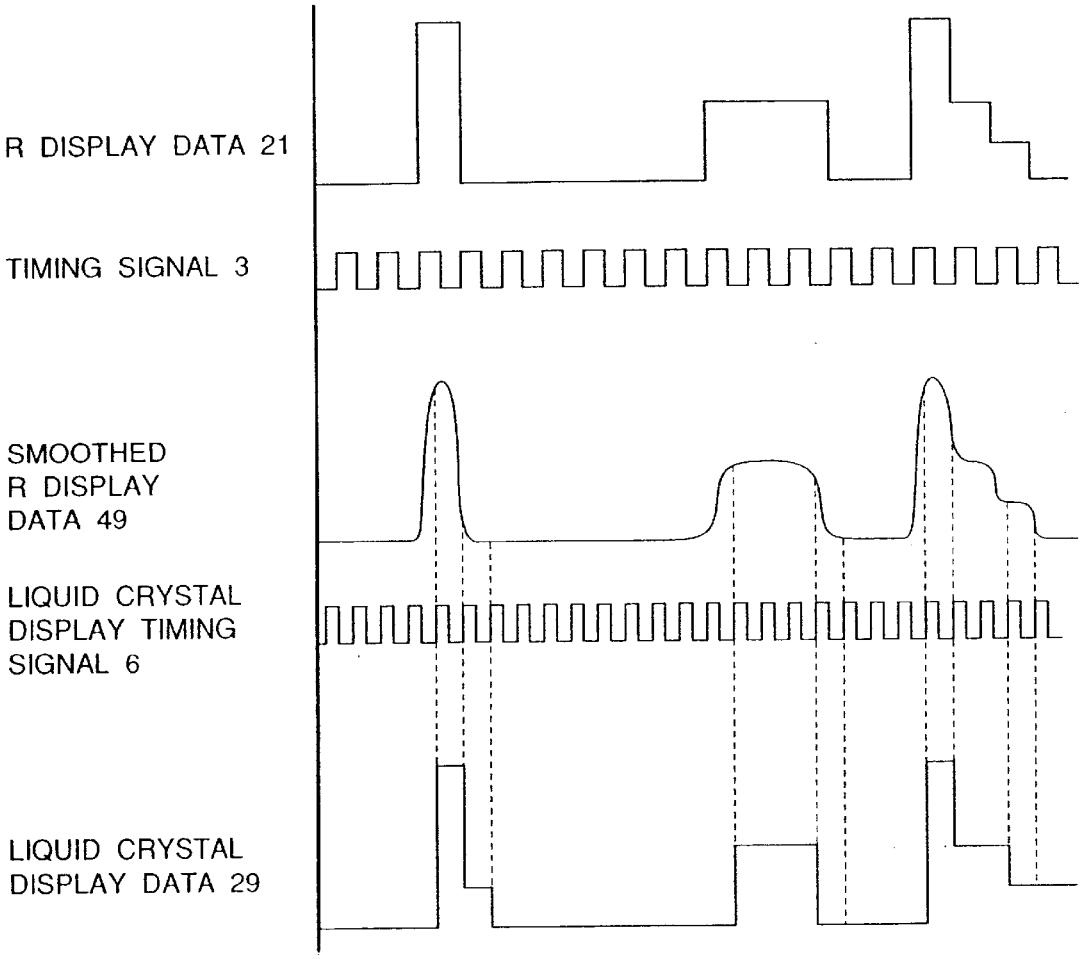
FIG. 10 is an illustration of DAD conversion operation of the system shown in FIG. 9.

FIG. 10 shows a signal conversion example of display data in the enlargement process.

Since the liquid crystal display timing signal 6 having higher frequency than the input timing signal 3 is used, enlarged R liquid crystal display data 29 is generated.

We have discussed the enlargement/reduction techniques as execution of the enlargement or reduction process so that the display data output from the PC 1 is made the same as the liquid crystal panel in resolution directly, but a technique which employs step-by-step execution of the enlargement or reduction process may be used. For example, to convert display data represented by 640×480 dots into 1120×780 dots, first the display data is first enlarged to 1280×960 dots, which is twice 640×480 dots, then the enlarged displayed data is reduced to 1120×780 dots. If an attempt is made to enlarge the display data directly to 1120×780 dots, it takes time because of a large number of insertion lines.

However, it does not take much time to enlarge the display data to 1280×960 equivalent to a double of 640×480 dots because of simple processing, and then only a few lines need to be removed. Therefore, the entire processing can be performed at high speed.

In contrast, if the resolution of the liquid crystal panel 7 in FIG. 1 is 640×480 dots and display data of 1120×780 dots is output from the PC 1, the enlargement process can be simply the reverse of the reduction process, which makes the processing fast.

In the invention, how the resolution should be adjusted can be determined automatically by providing means for determining what resolution the display data supplied to the liquid crystal display has, such as means for determining resolution from the timing signal input from the computer.

Another embodiment of a personal computer system to which a liquid crystal display system of the invention is connected will be discussed with reference to FIGS. 17 to 30.

The system configuration of another embodiment is the same as that shown in FIG. 1 except for the data conversion section 4.

Some operation examples of the data conversion section 4 will be discussed in another embodiment.

As the first operation example, a gradation integration/reduction system will be described with reference to FIG. 17.

Figure 17:
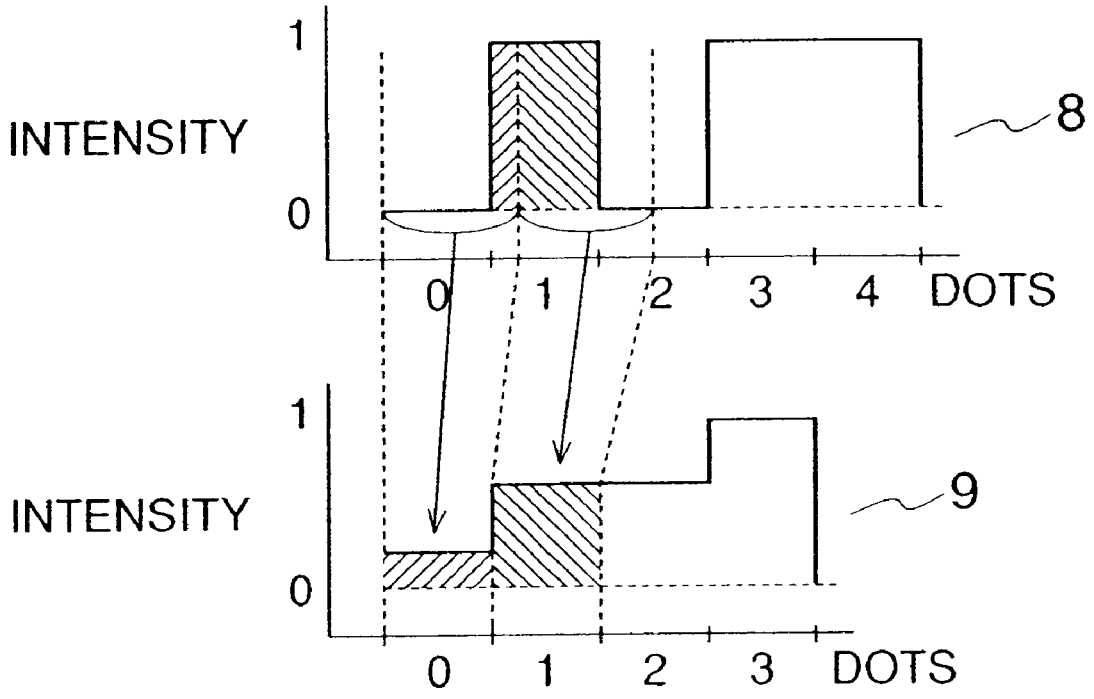
FIG. 17 is a drawing representing the concept of lateral reduction in another embodiment of the invention.

FIG. 17 shows the concept of the lateral reduction method in display mode 1 (1120×780 dots). Here, the reduction of five pixels to four pixels is discussed, and FIG. 17 represents R, G, or B color data.

In FIG. 17, numeral 8 indicates 5-pixel display data and numeral 9 indicates 4-pixel display data after reduction. The vertical axis is entered with 1 as the highest intensity and 0 as the lowest intensity and the horizontal axis is entered as pixel positions. To reduce the 5-pixel data 8 to the 4-pixel data 9, the 5-pixel width is virtually quartered, namely, the 1-pixel width is widened one-quarter and display data of five-quarter pixel width is converted into display data of 1-pixel width. Therefore, the calculation expression for the 1-pixel display data is $$X(0,0)'=(X(0,0)\times 4+X(0,1)\times 1)/5$$

$$X(0,1)'=(X(0,1)\times 3+X(0,2)\times 2)/5$$

$$X(0,2)'=(X(0,2)\times 2+X(0,3)\times 3)/5$$

$$X(0,3)'=(X(0,3)\times 1+X(0,4)\times 4)/5 \qquad \text{Expression 3}$$

where X (0, 0) to X (0, 4) are gray scale data for the first to fifth pixels before reduction and X (0, 0)' to X (0, 3)' are gray scale data for the first to fourth pixels after reduction, wherein the first digit represents the line number and the second digit represents the pixel number. That is, X (0, 0) is gray scale data for the first pixel of the first line and X (0, 1) is gray scale data for the second pixel of the first line. Since the description assumes that 1120 pixels are reduced to 1024 pixels, 35 pixels are reduced to 32 pixels from 1024/1120=32/35. The calculation expression is:

$$X(0,0)'=(X(0,0)\times 32+X(0,1)\times 3)/35$$

$$X(0,1)'=(X(0,1)\times 29+X(0,2)\times 6)/35$$

$$X(0,2)'=(X(0,2)\times 26+X(0,3)\times 9)/35$$

$$X(0,3)'=(X(0,3)\times 23+X(0,4)\times 12)/35$$

$$X(0,4)'=(X(0,4)\times 20+X(0,5)\times 15)/35$$

$$X(0,5)'=(X(0,5)\times 17+X(0,6)\times 18)/35$$

$$X(0,6)'=(X(0,6)\times 14+X(0,7)\times 21)/35$$

$$X(0,7)'=(X(0,7)\times 11+X(0,8)\times 24)/35$$

$$X(0,8)'=(X(0,8)\times 8X(0,9)\times 27)/35$$

$$X(0,9)'=(X(0,9)\times 5+X(0,10)\times 30)/35$$

$$X(0,10)'=(X(0,10)\times 2+X(0,11)\times 32+X(0,12)\times 1)/35$$

$$X(0,11)'=(X(0,12)\times 31+X(0,13)\times 4)/35$$

$$X(0,12)'=(X(0,13)\times 28+X(0,14)\times 7)/35$$

$$X(0,13)'=(X(0,14)\times 25+X(0,15)\times 10)/35$$

$$X(0,14)'=(X(0,15)\times 22+X(0,16)\times 13)/35$$

$$X(0,15)'=(X(0,16)\times 19+X(0,17)\times 16)/35$$

$$X(0,16)'=(X(0,17)\times 16+X(0,18)\times 19)135X(0,17)'=(X(0,18)\times 13+X(0,19)\times 22)/35$$

$$X(0,18)'=(X(0,19)\times 10+X(0,20)\times 25)/35$$

$$X(0,19)'=(X(0,20)\times 7+X(0,21)\times 28)/35$$

$$X(0,20)'=(X(0,21)\times 4+X(0,22)\times 31)/35$$

$$X(0,21)'=(X(0,22)\times 1+X(0,23)\times 32+X(0,24)\times 2)/35$$

$$X(0,22)'=(X(0,24)\times 30+X(0,25)\times 5)/35$$

$$X(0,23)'=(X(0,25)\times 27+X(0,26)\times 8)/35$$

$$X(0,24)'=(X(0,26)\times 24+X(0,27)\times 11)/35$$

$$X(0,25)'=(X(0,27)\times 21+X(0,28)\times 14)/35$$

$$X(0,26)'=(X(0,28)\times 18+X(0,29)\times 17)/35$$

$$X(0,27)'=(X(0,29)\times 15+X(0,30)\times 20)/35$$

$$X(0,28)'=(X(0,30)\times 12+X(0,31)\times 23)/35$$

$$X(0,29)'=(X(0,31)\times 9+X(0,32)\times 26)/35$$

$$X(0,30)'=(X(0,32)\times 6+X(0,33)\times 29)/35$$

$$X(0,31)'=(X(0,33)\times 3+X(0,34)\times 32)/35 \qquad \text{Expression 4}$$

where X (0, 0) to X (0, 34) are gray scale data for the first to 35th pixels before reduction and X (0, 0)' to X (0, 31)' are gray scale data of the first to 32nd pixels after reduction. Similar operations can also be performed in the longitudinal direction. However, to use a similar method for longitudinal processing, a memory for a plurality of lines would be required, which would increase the size of the circuit. Thus, the following processing can also be carried out so as not to increase the circuit scale.

Figure 18:
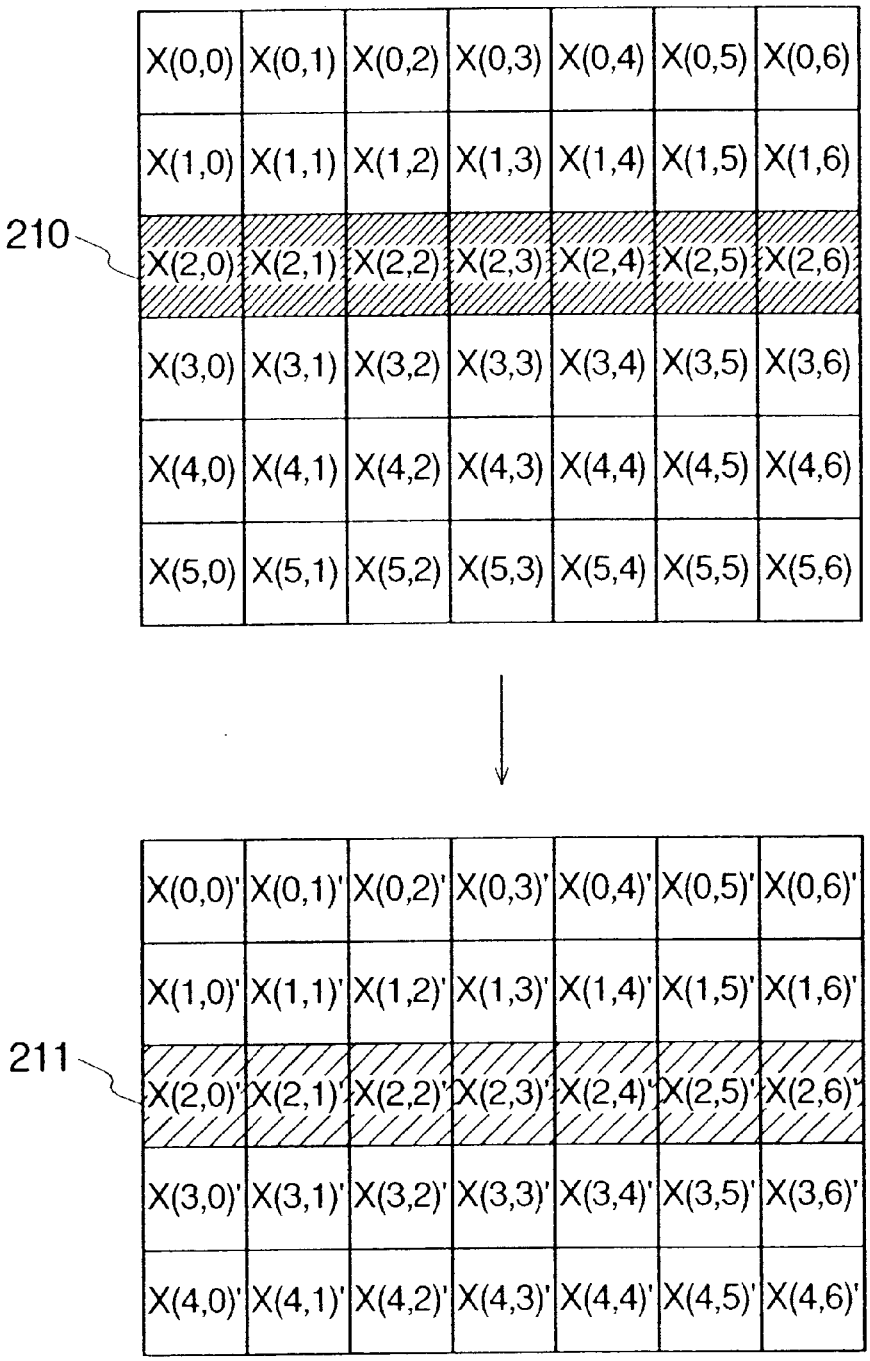
FIG. 18 is an illustration of reduction by gray scale replacement related to FIG. 17.

FIG. 18 shows reduction by gray scale replacement wherein a longitudinal reduction method is also shown.

To reduce 780 lines to 768 lines in the longitudinal direction, the deletion of 12 lines is required. In FIG. 18, numeral 210 indicates an extraction line to be deleted and numeral 211 indicates a replacement line after reduction. Longitudinal reduction is executed by replacing the extraction line 210 and the following line with the replacement line 211 which is the gray scale of the extraction line 210 and the following line. Therefore, pixels, other than the replacement line 211, to which "" is attached are pixels reduced using Expression 4 in the lateral direction, and to process the extraction line 210 and the following line using Expression 4 and average these two lines, the replacement line 211 is $$X(2,0)'=(X(2,0)\times 32+X(3,0)\times 32+X(2,1)\times 3+X(3,1)\times 3)/70$$

$$X(2,1)'=(X(2,1)\times 29+X(3,1)\times 29+X(2,2)\times 6+X(3,2)\times 6)/70$$

$$X(2,2)'=(X(2,2)\times 26+X(3,2)\times 26+X(2,3)\times 9+X(3,3)\times 9)/70$$

$$X(2,3)'=(X(2,3)\times 23+X(3,3)\times 23+X(2,4)\times 12+X(3,4)\times 12)/70$$

$$X(2,4)'=(X(2,4)\times 20+X(3,4)\times 20+X(2,5)\times 15+X(3,5)\times 15)/70$$

$$X(2,5)'=(X(2,5)\times 17+X(3,5)\times 17+X(2,6)\times 18+X(3,6)\times 18)/70$$

$$X(2,26)'=(X(2,28)\times 18+X(3,28)\times 18+X(2,29)\times 17+X(3,29)\times 17)/70$$

$$X(2,27)'=(X(2,29)\times 15+X(3,29)\times 15+X(2,30)\times 20+X(3,30)\times 20)/70$$

$$X(2,28)'=(X(2,30)\times 12+X(3,30)\times 12+X(2,31)\times 23+X(3,31)\times 23)/70$$

$$X(2,29)'=(X(2,31)\times 9+X(3,31)\times 9+X(2,32)\times 26+X(3,32)\times 26)/70$$

$$X(2,30)'=(X(2,32)\times 6+X(3,32)\times 6+X(2,33)\times 29+X(3,33)\times 29)/70$$

$$X(2,31)'=(X(2,33)\times 3+X(3,33)\times 3+X(2,34)\times 32+X(3,34)\times 32)/70 \qquad \text{Expression 5}$$

Data for the two lines (third and fourth lines) of the extraction lines is calculated. This method would require a 1-line memory, as described below in detail.

Figure 19:
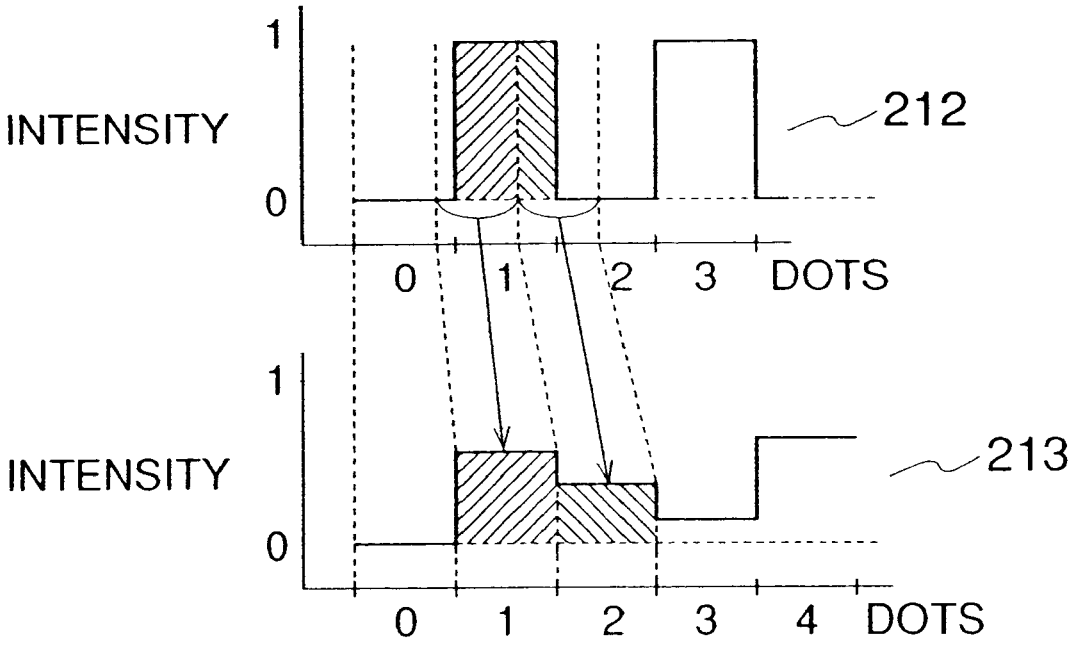
FIG. 19 is a drawing representing the concept of lateral enlargement in another embodiment of the invention.

FIG. 19 shows the concept for the lateral enlargement method in display mode 2 (640×480 dots). Here, enlargement of four pixels to five pixels is discussed.

In FIG. 19, numeral 212 indicates 4-pixel display data and numeral 213 indicates 5-pixel display data after enlargement. The vertical axis is entered with 1 as the highest intensity and 0 as the lowest intensity and the horizontal axis is entered as pixel positions. To enlarge the 4-pixel data 212 to the 5-pixel data 213, the 4-pixel width is divided into five equal parts, namely, the 1-pixel width is narrowed by one-fifth and display data of four-fifth pixel width is converted into display data of 1-pixel width. Therefore, the 1-pixel display data is expressed by $$X(0,0)'=(X(0,0)\times 4)/4$$

$$X(0,1)'=(X(0,0)\times 1+X(0,1)\times 3)/4$$

$$X(0,2)'=(X(0,1)\times 2+X(0,2)\times 2)/4$$

$$X(0,3)'=(X(0,2)\times 3+X(0,3)\times 1)/4$$

$$X(0,4)'=(X(0,3)\times 4)/4 \qquad \text{Expression 6}$$

where data to which"" is attached is gray scale data after processing. In fact, to enlarge 640 pixels to 1024 pixels, five pixels are enlarged to eight pixels from 1024/640=8/5. This is expressed by $$X(0,0)'=(X(0,0)\times 5)/5$$

$$X(0,1)'=(X(0,0)\times 3+X(0,1)\times 2)/5$$

$$X(0,2)'=(X(0,1)\times 5)/5$$

$$X(0,3)'=(X(0,1)\times 1+X(0,2)\times 4)/5$$

$$X(0,4)'=(X(0,2)\times 4+X(0,3)\times 1)/5$$

$$X(0,5)'=(X(0,3)\times 5)/5$$

$$X(0,6)'=(X(0,3)\times 2+X(0,4)\times 3)/5$$

$$X(0,7)'=(X(0,4)\times 5)/5 \qquad \text{Expression 7}$$

Like the reduction process, to use a similar method for longitudinal processing, a memory for a plurality of lines would be required, which would increase the size of the circuit. Thus, the following processing can also be performed so as not to increase the circuit scale.

Figure 20:
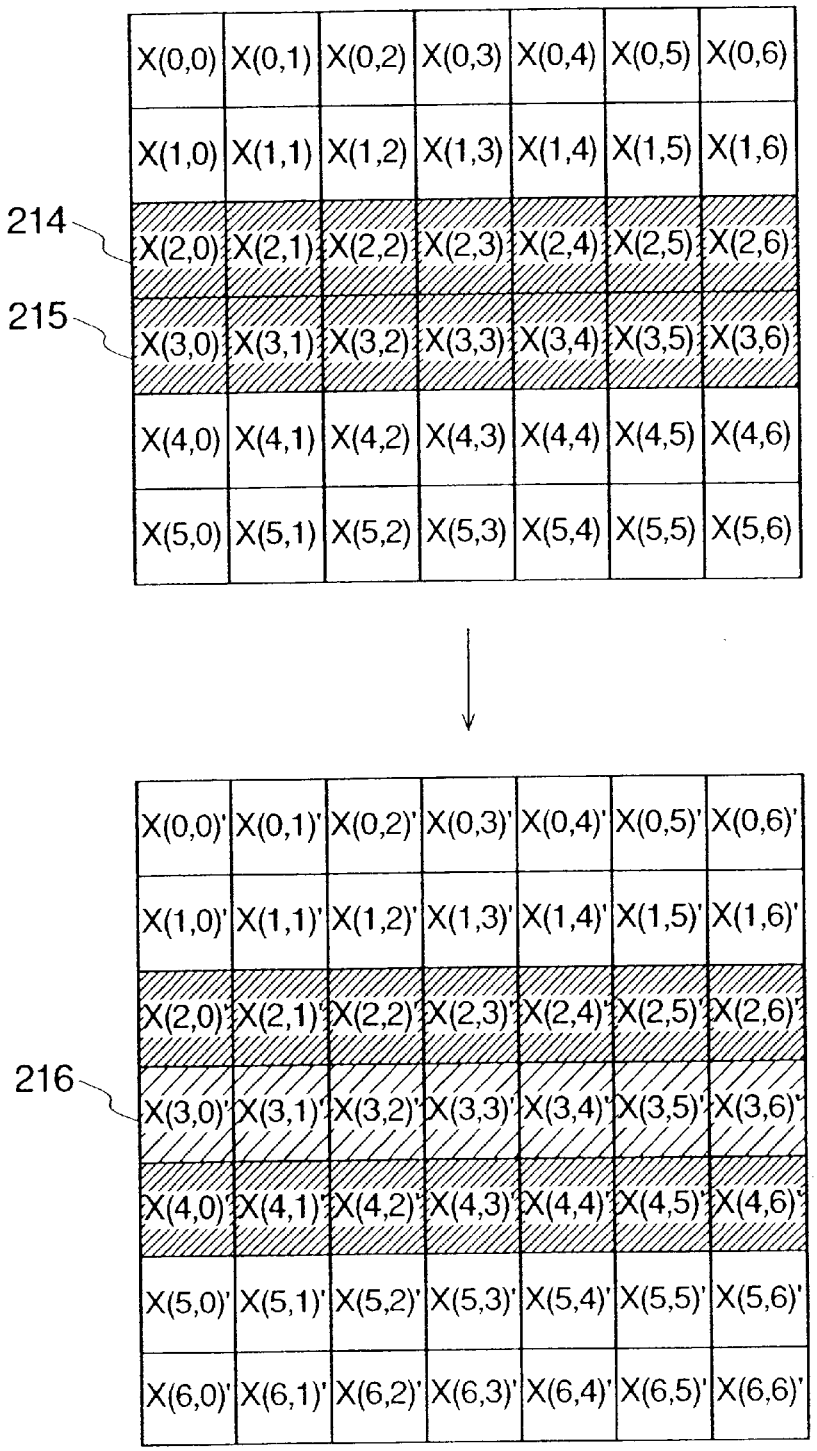
FIG. 20 is an illustration of enlargement by gray scale insertion related to FIG. 19.

FIG. 20 shows enlargement by gray scale insertion wherein a longitudinal enlargement method is also shown. To enlarge 480 lines to 768 lines in the longitudinal direction, the insertion of 288 lines is required. In FIG. 20, numerals 214 and 215 indicate extraction lines to represent the insertion position and numeral 216 indicates an insertion line after enlargement. Longitudinal enlargement is executed by inserting the insertion line 216 which is a gray scale for the extraction lines 214 and 215 between the extraction lines 214 and 215. Therefore, the pixels, other than the insertion line 216, to which"" is attached are pixels enlarged using Expression 4 in the lateral direction, and to process the extraction lines 214 and 215 using Expression 4 and average these two lines, the insertion line 216 is $$X(3,0)'=(X(2,0)\times 5+X(3,0)\times 5)/10$$

$$X(3,1)'=(X(2,0)\times 3+X(3,0)\times 3+X(2,1)\times 2+X(3,1)\times 2)/10$$

$$X(3,2)'=(X(2,1)\times 5+X(3,1)\times 5)/10$$

$$X(3,3)'=(X(2,1)\times 1+X(3,1)\times 1+X(2,2)\times 4+X(3,2)\times 4)/10$$

$$X(3,4)'=(X(2,2)\times 4+X(3,2)\times 4+X(2,3)\times 1+X(3,3)\times 1)/10$$

$$X(3,5)'=(X(2,3)\times 5+X(3,3)\times 5)/10$$

$$X(3,6)'=(X(2,3)\times 2+X(3,3)\times 2+X(2,4)\times 3+X(3,4)\times 3)/10$$

$$X(3,7)'=(X(2,4)\times 5+X(3,4)\times 5)/10 \qquad \text{Expression 8}$$

Data for two lines is calculated. The calculation is executed for each color, thereby converting the display data.

As described above, the calculation is executed separately for each of R, G, and B. At that time, fractional digits may occur. To clarify the difference between the background color and text and graphics colors, it is desirable to handle the fractional digits so that a color different from the background color is output in response to the attributes of the background color. For example, if the background is black (R=0000,G=0000,B=0000), when the average values of R, G, and B are calculated, fractions are rounded up or rounded off, and if the background is white (R=1111, G=1111, B=1111), fractions are rounded down, whereby a color different from the background color can be displayed. If the background color has different R, G, and B attributes such as blue (R=0000, G=0000,B=1111), fractions are rounded up when gradation of R or G is calculated, or fractions are rounded down when gradation of B is calculated.

The extraction line positions in longitudinal reduction or enlargement may be equally spaced as desired, or lines with less display data may be found and set to extraction lines.

Figure 21:
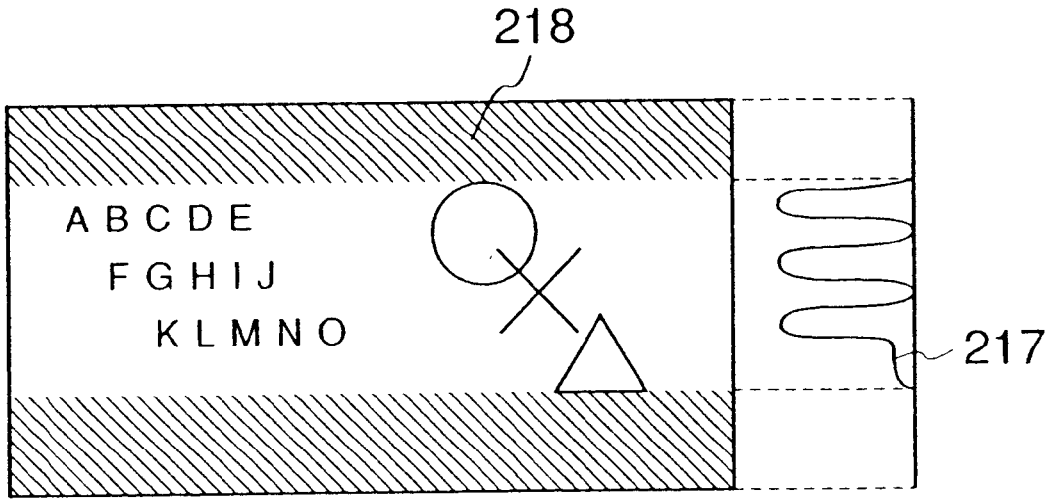
FIG. 21 is an illustration of a method for detecting a line with less display data.

Like FIG. 4, FIG. 21 shows a method of determining the position of a horizontal or vertical extraction line where replacement or insertion is to be made from the display data amount, wherein only a horizontally extending area is detected. In FIG. 21, numeral 217 indicates the summation result of the number of pixels displayed in a color different from the background color for each horizontal line and numeral 218 indicates positions of horizontal lines where insertion or deletion can be made, determined from the summation result 217. In the example, positions having as little display data as possible are found for replacement or insertion positions. For a screen with windows displayed, an area outside the window regions may be detected for replacement or insertion positions.

Next, an example of the hardware configuration of the data conversion section 4 for carrying out the first operation example shown in FIG. 17 will be discussed.

Figure 22:
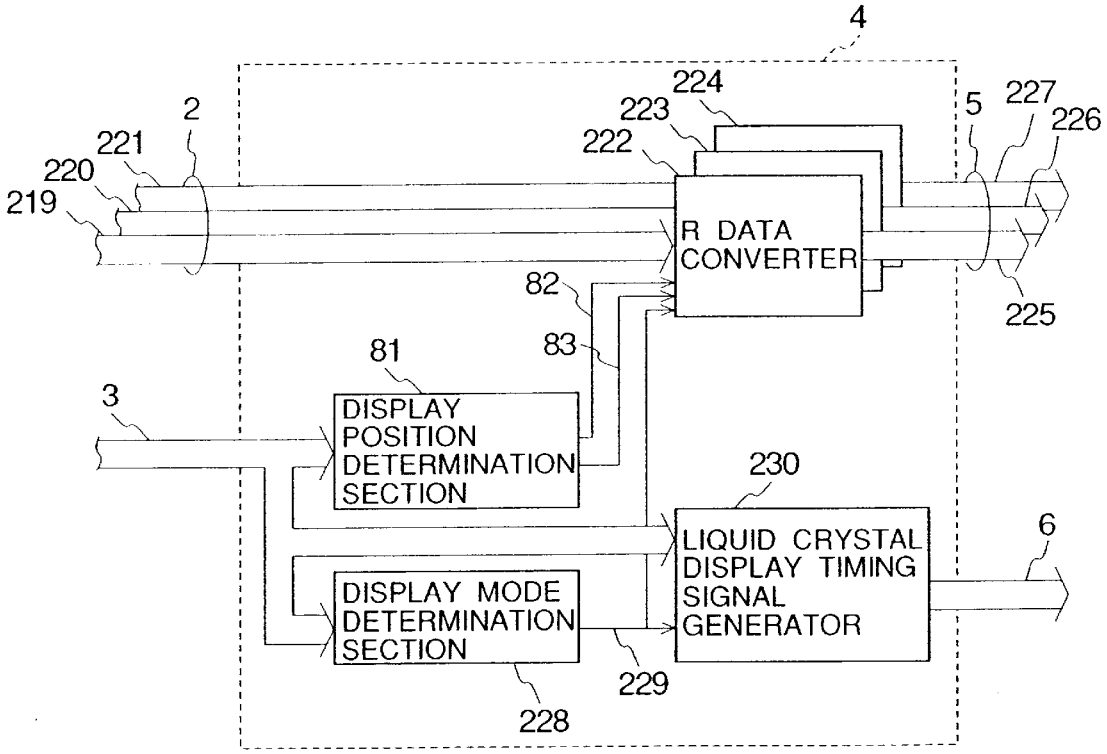
FIG. 22 is a block diagram showing the configuration of a data conversion section in another embodiment of the invention.

FIG. 22 is a configuration example of the data conversion section 4, wherein numerals 219, 220, and 221 indicate R display data, G display data, and B display data of display data 2 respectively, numeral 222 indicates an R data converter, numeral 223 indicates a G data converter, numeral 224 indicates a B data converter, numeral 225 indicates R liquid crystal display data, numeral 226 indicates G liquid crystal display data, numeral 227 indicates B liquid crystal display data, numeral 81 is a display position determination section, numeral 82 is a lateral display position signal, numeral 83 is a longitudinal display position signal, numeral 228 indicates a display mode determination section, numeral 229 indicates a display mode signal, and numeral 230 indicates a liquid crystal display timing signal generator. The display position determination section 81 determines the display position of each pixel of the display data 2 from a timing signal 3 and outputs the lateral position as the lateral display position signal 82 and the longitudinal position as the longitudinal display position signal 83. The display mode determination section 228 determines the display mode from the timing signal 3 and outputs the display mode signal 229. The data converters 222, 223, and 224 process the R, G, and B display data 219, 220, and 221 respectively in accordance with the resolution represented by the display mode signal 229 and the display position indicated by the lateral and longitudinal display position signals 82 and 83. The liquid crystal display timing signal generator 230 generates a liquid crystal display timing signal 6 matched with the output resolution represented by the display mode signal 229 from the timing signal 3.

Figure 23:
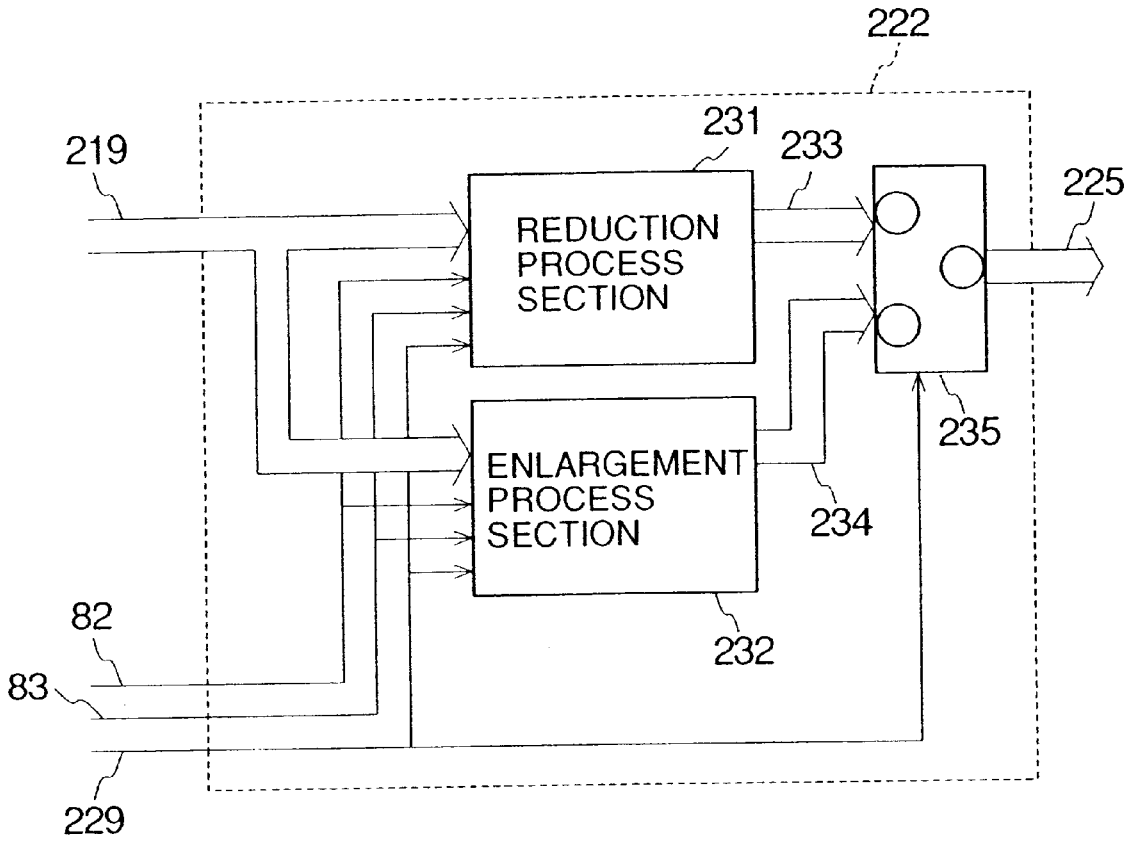
FIG. 23 is a block diagram showing the configuration of the R data converter shown in FIG. 22.

FIG. 23 is an example of the configuration of the R data converter 222. The G and B data converters 223 and 224 also each have the same configuration as the R data converter 24.

In FIG. 23, numeral 231 indicates a reduction process section, numeral 232 indicates an enlargement process section, numeral 233 indicates reduced display data, numeral 234 indicates enlarged display data, and numeral 235 indicates a resolution switch means. When the display mode signal 229 represents the display mode 1, the reduction process section 231 converts the R display data 219 into the reduced display data 233 in response to the lateral display position signal 82 and longitudinal display position signal 83; at that time, the enlargement process section 232 does not operate. When the display mode signal 229 represents the display mode 2, the enlargement process section 232 converts the R display data 219 into the enlarged display data 234 in response to the lateral display position signal 82 and longitudinal display position signal 83, at that time, the reduction process section 231 does not operate. The resolution switch means 235 is responsive to the display mode signal 229 for outputting the reduced display signal 233 when the signal 229 represents the display mode 1 or the enlarged display signal 234 when the signal 229 represents the display mode 2 as the R liquid crystal display signal 225. Although the reduction process section 231 and the enlargement process section 232 are provided to support two display modes in the embodiment, additional reduction or enlargement process sections can also be provided for supporting other resolutions.

Figure 24:
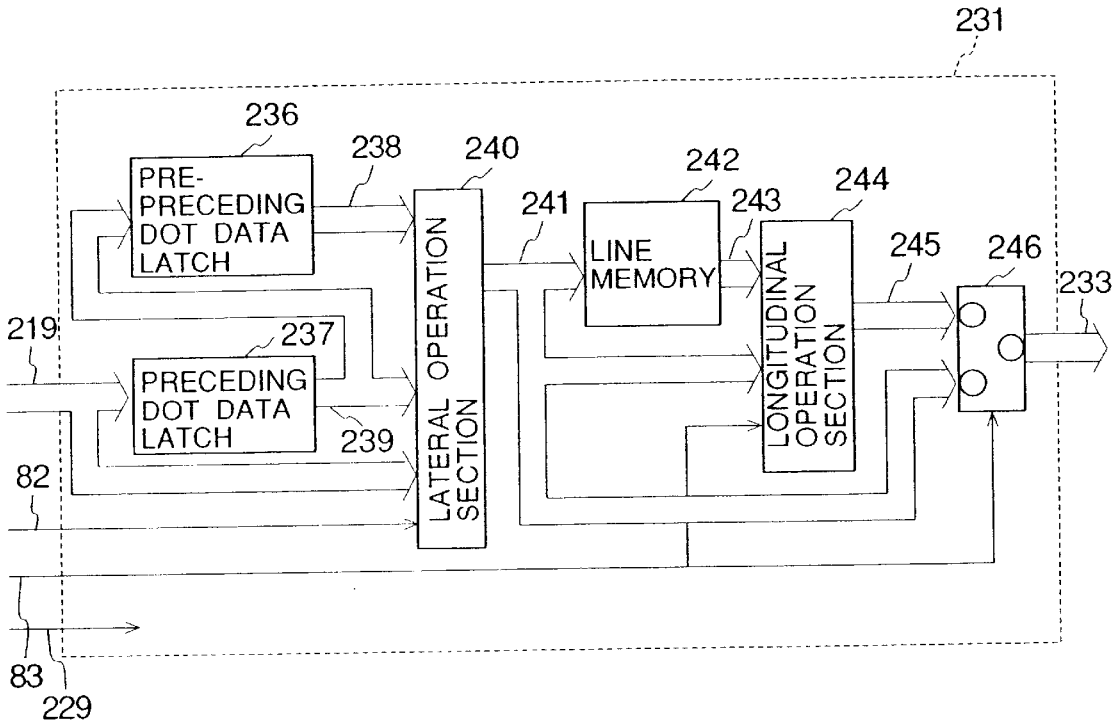
FIG. 24 is a block diagram showing the configuration of the reduction process section shown in FIG. 23.

FIG. 24 is one example of the configuration of the reduction process section 231. As described above, a horizontal row of pixels of display data is referred to as a line. This means that the liquid crystal panel 7 used in the invention consists of 1024 pixels×768 lines and that the display mode 1 provides 1120 pixels×780 lines.

In FIG. 24, numeral 236 indicates a pre-preceding dot data latch, numeral 237 indicates a preceding dot data latch, numeral 238 indicates pre-preceding dot data, numeral 239 indicates preceding dot data, numeral 240 indicates a lateral operation section, numeral 241 indicates laterally reduced data, numeral 242 indicates a line memory, numeral 243 indicates preceding line data, numeral 244 indicates a longitudinal operation section, numeral 245 indicates longitudinal gray scale data and numeral 246 indicates an output selector. The preceding dot data latch 237, which latches the R display data 219 in response to a dot clock, outputs the preceding dot data 239 which is display data one pixel before the R display data 219. The pre-preceding dot data latch 236, which latches the preceding dot data 239 in response to a dot clock, outputs the pre-preceding dot data 238 which is display data two pixels before the R display data 219. The lateral operation section 240 performs an operation on the R display data 219 and the preceding dot data 239, the pre-preceding dot data 238 according to Expression 4 in response to the lateral display position signal 82 depending on which pixel position of the liquid crystal panel 7 the R display data 219 is at, and outputs the result as the laterally reduced data 241, as described below in detail. The line memory 242 stores one line of the laterally reduced data 241 and outputs as the preceding line data 243 which is data one line before when the R display data 219 of the next line is input. The longitudinal operation section 244 performs an operation on the laterally reduced data 241 and the preceding line data 243 in response to the longitudinal display position signal 83 depending on which line position of the liquid crystal panel 7 the R display data 219 is at, and outputs the result as the longitudinal gray scale data 245, as described below in detail. The output data selector 246 selects the laterally reduced data 241 or the longitudinal gray scale data 245 and outputs or does not output them in response to the longitudinal display position signal 83, as described in detail below.

Figure 25:
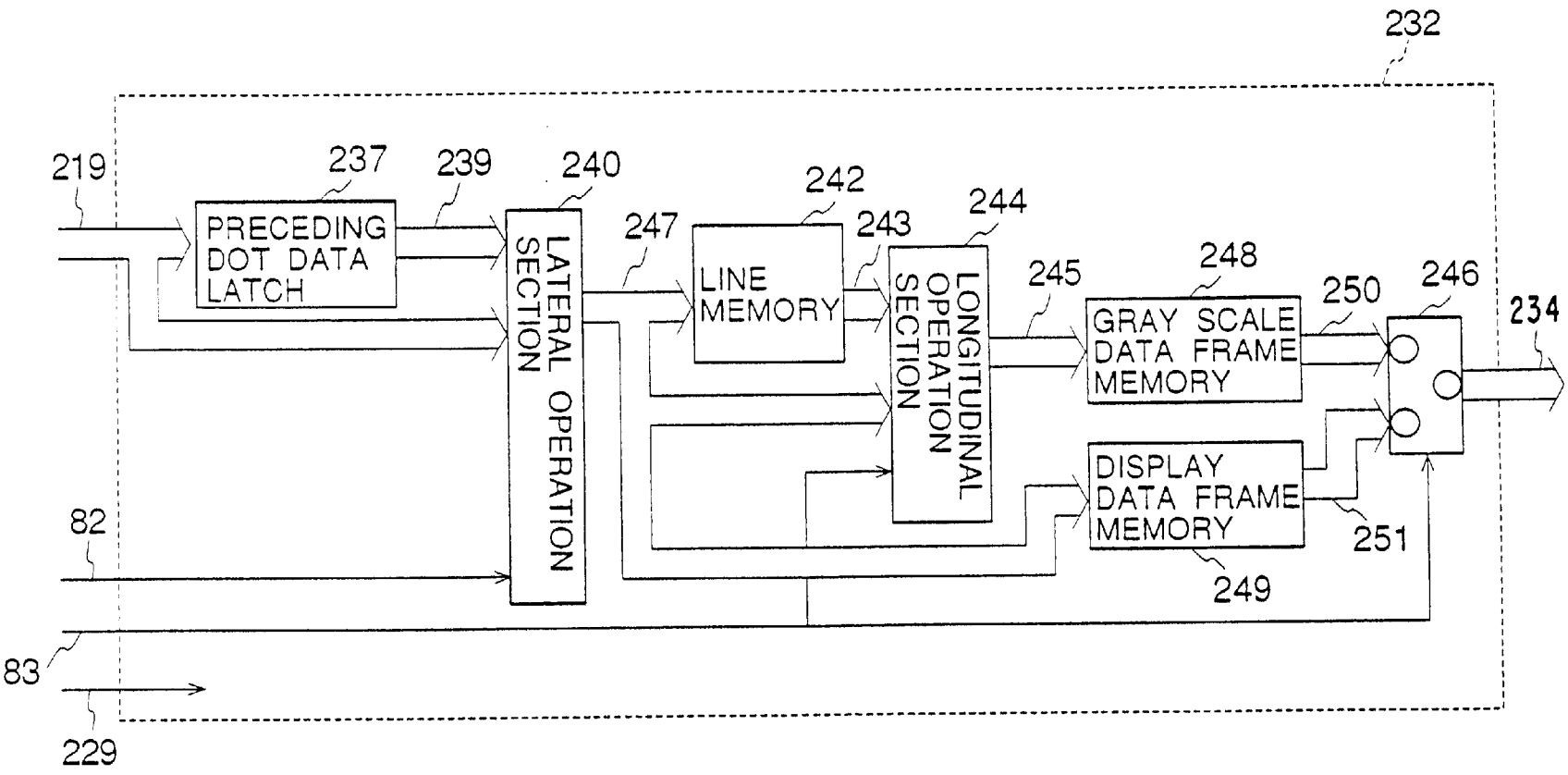
FIG. 25 is a block diagram showing the configuration of the enlargement process section shown in FIG. 23.

FIG. 25 is an example of the configuration of the enlargement process section 232, wherein numeral 247 indicates laterally enlarged data, numeral 248 indicates a gray scale data frame memory, numeral 249 indicates a display data frame memory, numeral 250 indicates read insertion data, and numeral 251 indicates read display data. Other components identical with those of the reduction process section 231 previously described with reference to FIG. 24 are denoted by the same reference numerals in FIG. 25.

In FIG. 25, a preceding dot data latch 237 operates like that of the reduction process section 231. The lateral operation section 240 performs an operation according to Expression 7 in response to the lateral display position signal 82 and outputs the result as the laterally enlarged data 247. A line memory 242 and a longitudinal operation section 244 operate like those of the reduction process section 231. The gray scale data frame memory 248 stores longitudinal gray scale data 245 for one frame and the display data frame memory 249 stores laterally enlarged data 247 for one frame. When display data of the next frame is input, the read insertion data 250 is read and inserted into any position between the read display data 251 in response to the longitudinal display position signal 83 for performing enlargement processes.

Next, the operation related to the reduction process according to the invention will be discussed in detail.

In FIG. 1, the data conversion section 4 converts the display data 2 and the timing signal 3 into the liquid display data 5 and the liquid crystal display timing signal 6 matched with the liquid crystal panel 7 for output. In FIG. 22, the display position determination section 81 determines the position at which display data is to be displayed from the timing signal 3 and generates the lateral display position signal 82 and the longitudinal display position signal 83. The lateral display position can be determined by counting liquid crystal display clock pulses (dot clock pulses) of the timing signal 3 and the longitudinal display position can be determined by counting liquid crystal horizontal clock pulses (line clock pulses) of the timing signal 3. The display mode determination section 228 determines the display mode from the timing signal 3 and the display mode signal 229 matched with the resolution of the liquid crystal panel 7 for display. To determine the display mode, the number of lateral (horizontal) dots can be determined by counting the number of liquid crystal display clocks in one period of the liquid crystal horizontal clock of the timing signal 3 and the number of longitudinal (vertical) lines can be determined by counting the number of liquid crystal horizontal synchronizing signal periods in one period of liquid crystal vertical synchronizing signal. The display mode signal 229 can also be fed from an external system without providing the display mode determination section 228.

The R, G, and B for the display data 2 are input to the R, G, and B data converters 222, 223, and 224 respectively, which then convert the data into the liquid crystal display data 5 matched with the display mode represented by the display mode signal 229. The liquid crystal display timing signal generator 230 generates the liquid crystal display timing signal 6 matched with the display mode represented by the display mode signal 229 from the timing signal 3.

The operation of the R data converter 222 for display data conversion will be discussed in detail with reference to FIG. 23. Each of the G and B data converters 223 and 224 performs similar operations to that of the R data converter 222.

In FIG. 23, when the display mode signal 229 represents the display mode 1, the reduction process section 231 operates and generates the reduced display data 233 in response to the lateral display position signal 82 and the longitudinal display position signal 83. When the display mode signal 229 represents the display mode 2, the enlargement process section 232 operates and generates the enlarged display data 234 in response to the lateral display position signal 82 and the longitudinal display position signal 83. The resolution switch means 235 is responsive to the display mode signal 229 for selecting and outputting the reduced display data 233 in the display mode 1 or the enlarged display data 234 in the display mode 2. As described above, additional reduction and enlargement process sections can be provided to make up a data conversion section which supports every resolution.

The operation of the reduction process section 231 will be discussed in detail with reference to FIGS. 24, 27, and 28. In FIG. 24, the preceding dot data latch 237, which latches R display data 219 according to a dot clock, outputs the preceding dot display data 239 which is the data one dot before the R data 219. The pre-preceding dot data latch 236, which latches the preceding dot data 239 according to a dot clock, outputs the pre-preceding dot data 238 which is the data two dots before the R data 219. The lateral operation section 240 comprises an adder, multiplier, and divider. When the R display data 219 indicated by the lateral display position signal 82 is at the positions X (0, 1) to X (0, 10), X (0, 13) to X (0, 22), and X (0, 25) to X (0, 34) shown in Expression 4, the lateral operation section 240 performs an operation on the R display data 219 and the preceding dot data 239; when the R display data 219 is at the positions X (0, 12) and X (0, 24), the lateral operation section 240 performs an operation on the R display data 219, the preceding dot data 239, and the pre-preceding dot data 238; and when the R display data 219 is at the positions X (0, 0), X (0, 11), and X (0, 23), the lateral operation section 240 does not output any data, thereby executing the operation shown in Expression 4. Lateral reduction can be accomplished by repeating similar calculations in 35-dot units. When the position of the R display data 219 indicated by the longitudinal display position signal 83 is the line next to the extraction line 210 shown in FIG. 18, the longitudinal operation section 244 performs an operation on the laterally reduced data 241 and the preceding line data 243; otherwise, the longitudinal operation section 244 does not operate. When the position of the R display data 219 indicated by the longitudinal display position signal 83 is the extraction line 210 shown in FIG. 18, the output data selector 246 does not output display data; when the position is the line next to the extraction line 210 shown in FIG. 18, the output data selector 246 outputs the longitudinal reduced data 245; otherwise, it outputs the laterally reduced data 241.

Figure 27:
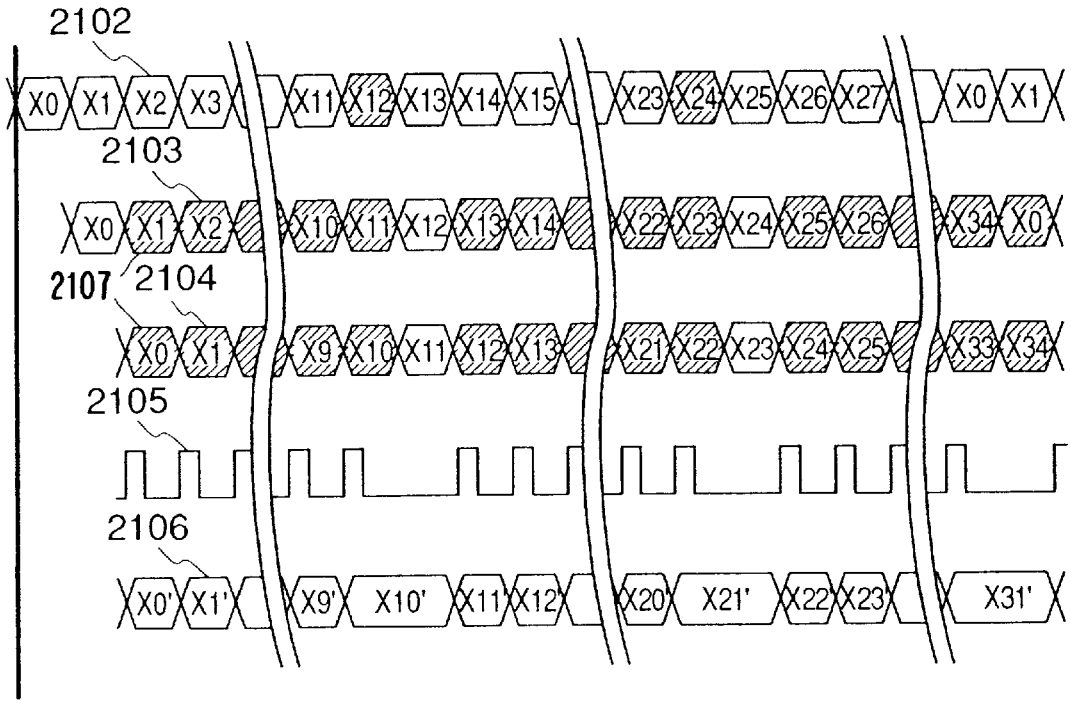
FIG. 27 is an input/output timing chart for the lateral reduction process.

FIG. 27 is an input/output timing chart for the lateral reduction process for the reduction process section 231.

In the figure, numeral 2102 indicates the input timing for the R display data 219, numeral 2103 indicates the output timing of preceding dot data 239, numeral 2104 indicates the output timing for the pre-preceding dot data 238, numeral 2105 indicates the output timing for the synchronous clock contained in the liquid crystal display timing signal 6, numeral 2106 indicates the output timing of laterally reduced data 241, and numeral 2107 indicates hatched data on which a lateral operation is to be performed. Each number following X represents the lateral display position (dot position) 0 to 34. Each number to which "'" is suffixed, shown in the output timing 2104 of the laterally reduced data 241 represents the display position after lateral reduction. For example, the first dot X0' of the laterally reduced data 241 is the result of performing an operation on X0 and X1 shown as hatched data 2107, and X10 is the result of performing an operation on X10, X11, and X12. The operation is performed according to Expression 4 in response to the lateral display position signal 82. The clock at the positions of X0, X11, and X23 of the R display data 219 is stopped and laterally reduced data 241 is output in synchronization with it, thereby deleting 3-dot data.

Figure 28:
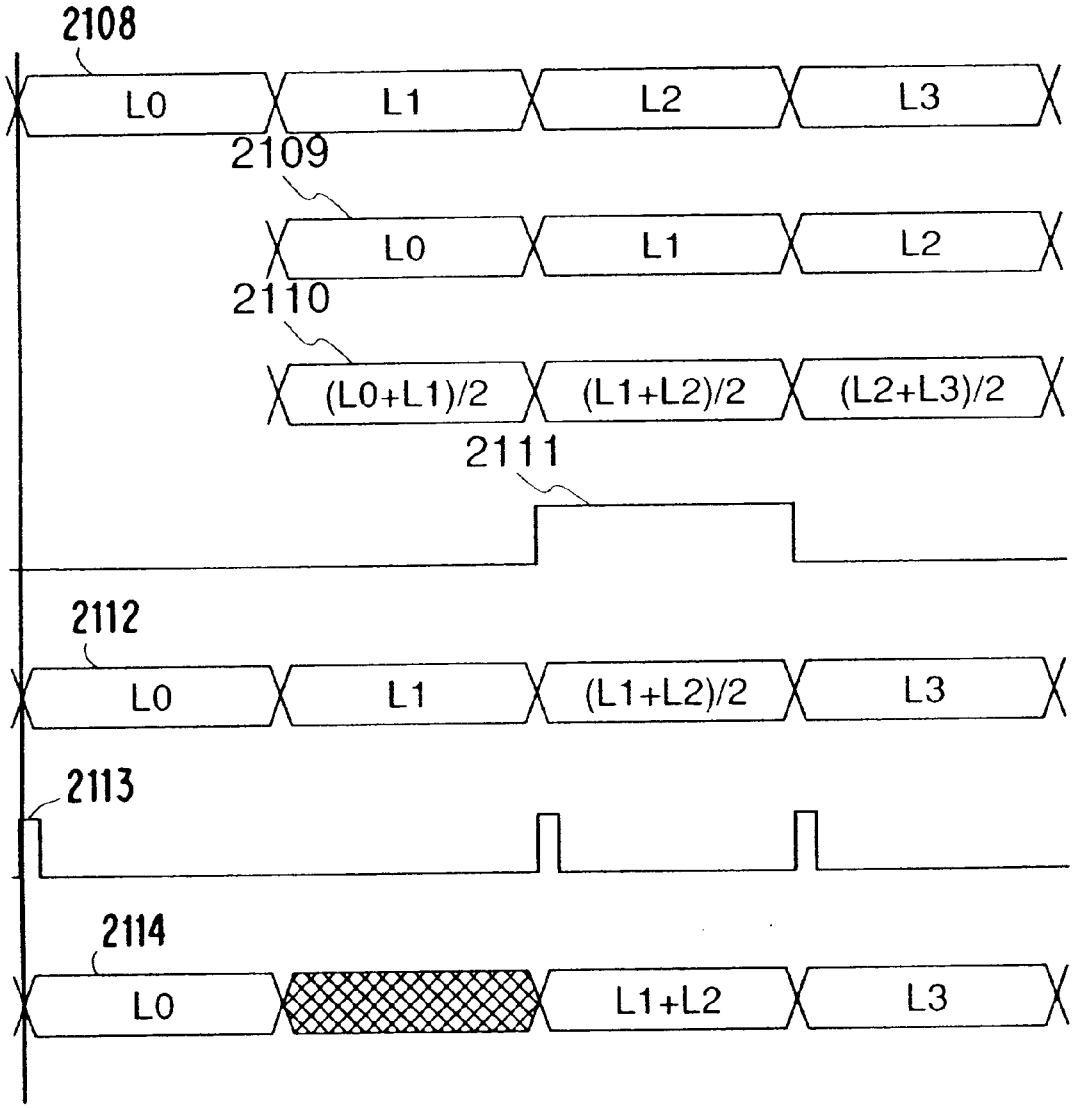
FIG. 28 is an input/output timing chart for the longitudinal reduction process.

FIG. 28 is an input/output timing chart for the longitudinal reduction process for the reduction process section 231.

In the figure, numeral 2108 indicates the line output timing for the laterally reduced data, numeral 2109 indicates the output timing of the preceding line signal 243 output by the line memory 242, numeral 2110 indicates the output timing of longitudinal gray scale data 245 generated by performing an operation on the output of the line memory and the laterally reduced data, and numeral 2112 indicates the output timing of the reduced display data 233 output from the output data selector 246. L0 and L1 denote data for the first line and data for the second line respectively; L0 and L1 are averaged to generate the longitudinal reduced data. This also applies to the second line, third line, and later. Numeral 2111 indicates a longitudinal position signal, which becomes a selection signal for the output data selector 246 to allow the longitudinal reduced data 245 to be output on the line next to the extraction line 210 shown in FIG. 18. Numeral 2112 indicates the output timing for the reduced display data 233, numeral 2113 indicates the output timing for a horizontal synchronizing signal contained in the liquid crystal display timing signal 6, and numeral 2114 indicates the timing of display data actually displayed. Although the output timing 2112 for the output data selector 246 follows the longitudinal position signal timing 2111, L1 is not displayed as shown in 2114 because the actual horizontal synchronizing signal is as shown in 2113.

The enlargement process according to the invention will be discussed in detail with reference to FIGS. 25, 12, and 29.

In FIG. 25, the preceding dot data latch 237 operates like that for the reduction process section 53. When R display data 219 indicated by the lateral display position signal 82 is data at the dot position X (0, 0) shown in Expression 6, the lateral operation section 240 performs an operation only on the R display data 219; when the R display data 219 is data at the dot position X (0, 1), X (0, 3), or X (0, 4), the lateral operation section 240 outputs 2-dot data for the operation result on the R display data 219 and the preceding dot data 239 and the operation result on only the R display data 219 while 1-dot R display data 219 is input; when the R display data 219 is data at the dot position X (0, 2), the lateral operation section 240 performs an operation on the R display data 219 and the preceding dot data 239.

In FIG. 25, the line memory 242 and the longitudinal operation section 244 operate like those of the reduction process section 231. Longitudinal gray scale data 245 for one screen (frame) is stored in the gray scale data frame memory a 248 and laterally enlarged data 247 for one screen (frame) is stored in the display data frame memory 249. When display data for the next screen (frame) is input, the read insertion data 250 is read and inserted into any position between the read display data 251 in response to the longitudinal display position signal for inserting a horizontal line. When a number of insertion lines are equally spaced, for example, when a gray scale line is inserted every n lines, (n+1) line memories are provided for storing inserted gray scale data and line data. When the next data is input, the (n+1)-line data containing the gray scale line data is read out while n-line data is stored, whereby a horizontal line can be inserted without Providing the frame memories.

Figure 26:
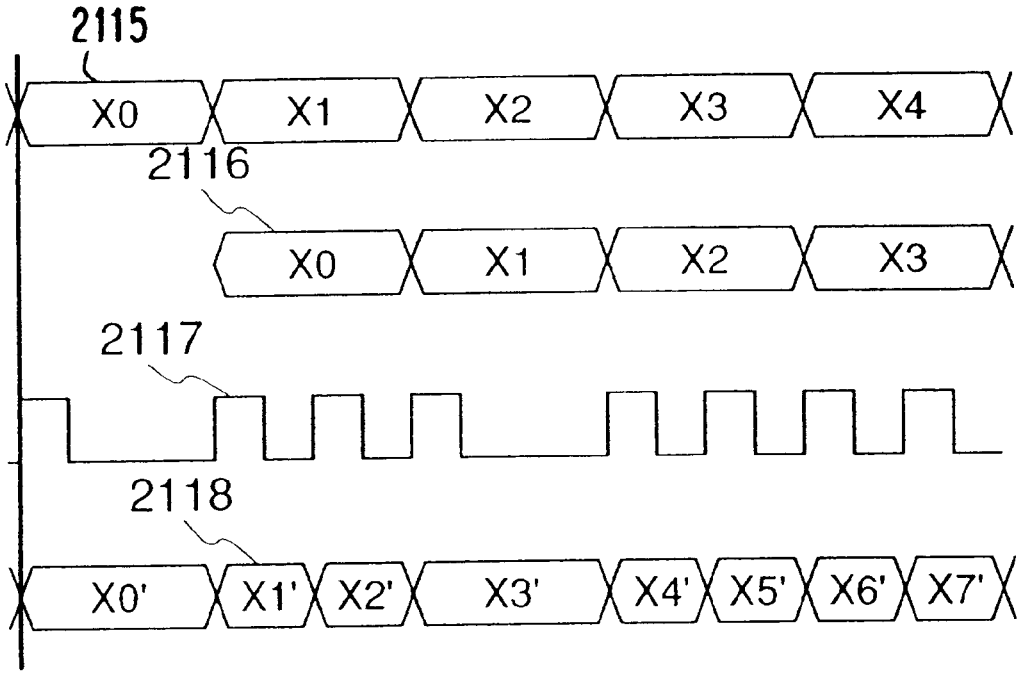
FIG. 26 is an input/output timing chart for the lateral enlargement process.

FIG. 26 is an input/output timing chart for the lateral enlargement process of the enlargement process section 232.

In the figure, numeral 2115 indicates the input timing of R display data 219, numeral 2116 indicates the output timing of Preceding dot data 239, and numeral 2117 indicates the output timing of a synchronous clock contained in the liquid crystal display timing signal 6, and numeral 2118 indicates the output timing of laterally enlarged data 247. Each digit following X represents the lateral display Position (dot Position) 0 to 4. X0' to X7' of the laterally enlarged data 247 are the operation results according to Expression 7; while 5-dot data is input, 8-dot data is output according to the synchronous clock timing 2117.

Figure 29:
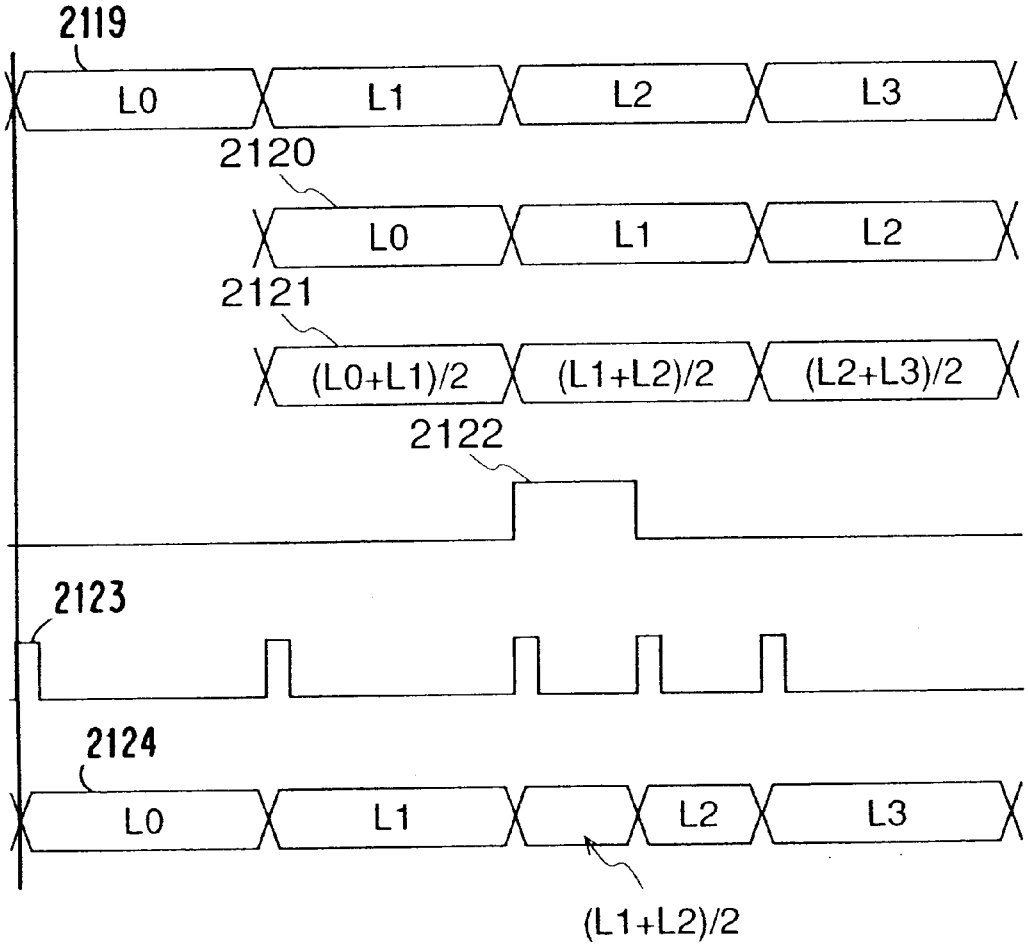
FIG. 29 is an input/output timing chart for the longitudinal enlargement process.

FIG. 29 is an input/output timing chart for the longitudinal enlargement process of the enlargement process section 232.

In the figure, numeral 2119 indicates the output timing of laterally enlarged data 247 for each line, numeral 2120 indicates the output timing of the preceding line data 243 for each line, output from the line memory 242, and numeral 2121 indicates the output timing of longitudinal gray scale data 245 for each line, showing that the longitudinal gray scale data 245 is the result of dividing by two the sum of the laterally enlarged data 247 and the preceding line data 243 which is the data one line before the laterally enlarged data 247. Numeral 2122 indicates the input timing of the longitudinal display position signal 83, numeral 2123 indicates a horizontal synchronizing signal contained in the liquid crystal display timing signal 6, and numeral 2124 indicates the timing for each line displayed on the liquid crystal panel 7. The longitudinal display position signal input timing 2122 is set to "1" on the line next to the extraction line 214 shown in FIG. 20. At this time, the period of the synchronous clock is doubled and while 1-line data is input, 2-line data is output. For the first one of these two lines, the longitudinal gray scale data is selectively output from the gray scale data frame memory 248 and for the second line, the laterally enlarged data is selectively output from the display data frame memory 249 by the output selector 246.

Next, a system which simplifies the operation section will be discussed as another example of the data conversion section 4 according to another embodiment of the invention.

To simplify the operation expressions given in the first example of the data conversion section 4, the dividers may be omitted by assigning 8 or 16 to each divisor. Therefore, the operation section can be simplified by reducing 16 pixels to 15 pixels according to Expression 9 or eight pixels to seven pixels according to Expression 10:

$$X(0,0)'=(X(0,0)\times 15+X(0,1)\times 1)/16$$

$$X(0,1)'=(X(0,1)\times 14+X(0,2)\times 2)/16$$

$$X(0,2)'=(X(0,2)\times 13+X(0,3)\times 3)/16$$

$$X(0,3)'=(X(0,3)\times 12+X(0,4)\times 4)/16$$

$$X(0,4)'=(X(0,4)\times 11+X(0,5)\times 5)/16$$

$$X(0,5)'=(X(0,5)\times 10+X(0,6)\times 6)/16$$

$$X(0,6)'=(X(0,6)\times 9+X(0,7)\times 7)/16$$

$$X(0,7)'=(X(0,7)\times 8+X(0,8)\times 8)/16$$

$$X(0,8)'=(X(0,8)\times 7+X(0,9)\times 9)/16$$

$$X(0,9)'=(X(0,9)\times 6+X(0,10)\times 10)/16$$

$$X(0,10)'=(X(0,10)\times 5+X(0,11)\times 11)/16$$

$$X(0,11)'=(X(0,11)\times 4+X(0,12)\times 12)/16$$

$$X(0,12)'=(X(0,12)\times 3+X(0,13)\times 13)/16$$

$$X(0,13)'=(X(0,13)\times 2+X(0,14)\times 14)/16$$

$$X(0,14)'=(X(0,14)\times 1+X(0,15)\times 15)/16 \qquad \text{Expression 9}$$

$$X(0,0)'=(X(0,0)\times 7+X(0,1)\times 1)/8$$

$$X(0,1)'=(X(0,1)\times 6+X(0,2)\times 2)/8$$

$$X(0,2)'=(X(0,2)\times 5+X(0,3)\times 3)/8$$

$$X(0,3)'=(X(0,3)\times 4+X(0,5)\times 5)/8$$

$$X(0,4)'=(X(0,4)\times 3+X(0,1)\times 1)/8$$

$$X(0,5)'=(X(0,5)\times 2+X(0,6)\times 6)/8$$

$$X(0,6)'=(X(0,6)\times 1+X(0,7)\times 7)/8 \qquad \text{Expression 10}$$

These expressions can be used to reduce 1120 lateral pixels to 1024 pixels by reducing from 16 pixels to 15 pixels for 704 pixels of the 1120 pixels and from eight pixels to seven pixels for 416 pixels. Thus, reduction process compatible with every resolution can be carried out by combining reduction methods by which dividers can be omitted.

As still another example of the data conversion section 4, a system which executes reduction process in dot units will be discussed with reference to FIG. 30. Here, assume that a dot refers to a display element of each of R, G, and B making up one pixel of a color liquid crystal panel and that one pixel consists of three dots. The pixels of R, G, and B are arranged in order on a horizontal line on the liquid crystal panel.

Figure 30:
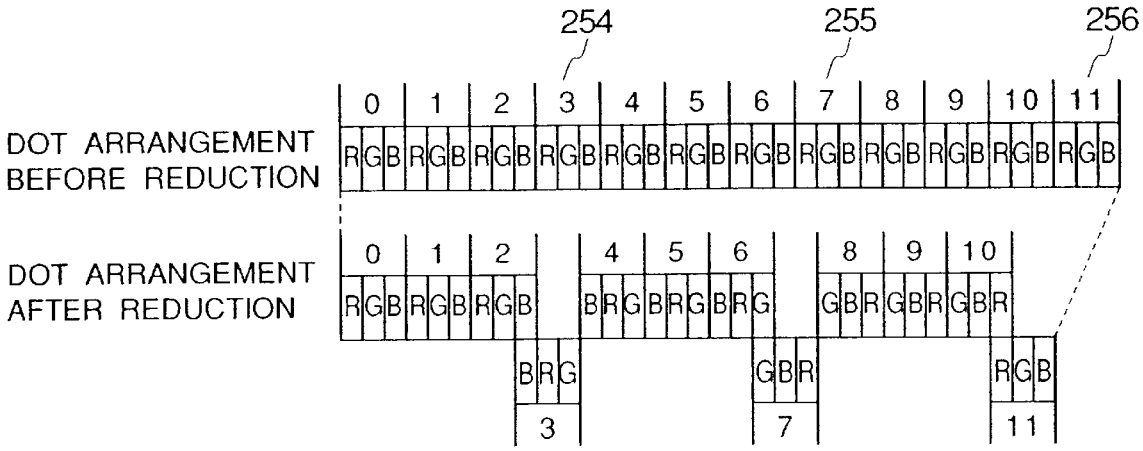
FIG. 30 is a conceptual diagram of the reduction process executed in dot units.

FIG. 30 shows a concept of reduction process executed in dot units. Here, assume that 12 pixels are to be reduced to 11 pixels, namely, 36 dots to 33 dots.

In FIG. 30, numerals 254, 255, and 256 indicate first, second, and third extraction pixels respectively. Gray scale (average) of the display data in the B dot of the first extraction pixel 254 and the display data in the B dot of its preceding pixel is calculated and the result is displayed in the B dot of the pixel preceding the first extraction pixel 254. Gray scale (average) of the display data in the G dot of the second extraction pixel 255 and the display data in the G dot of its preceding pixel is calculated and the result is displayed in the G dot of the pixel preceding the second extraction pixel 255. Gray scale (average) of the display data in the R dot of the third extraction pixel 256 and the display data in the R dot of its preceding pixel is calculated and the result is displayed in the R dot of the pixel preceding the third extraction pixel 256. Since the system performs reduction process in units of dots smaller than pixels, characters and graphics are less deformed. Alternatively, six pixels can also be reduced to five pixels, namely, 18 dots to 15 dots.

The data conversion section 4 which performs the processing may be software using the CPU 101, may be made of hardware, may exist in the PC 1, or may be contained in the liquid crystal panel 7.

An example of a system to which the invention is applied will be discussed with reference to FIGS. 31 and 32.

Figure 31:
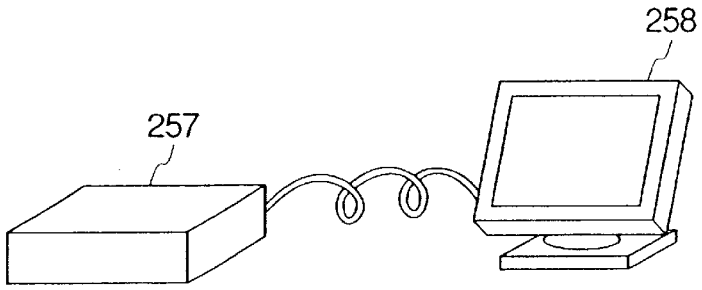
FIG. 31 is a conceptual illustration of a system to which the invention is applied.

FIG. 31 is a conceptual illustration of the system to which the invention is applied.

In FIG. 31, numeral 257 indicates a workstation or personal computer which contains a central processing unit and a numeral 258 indicates a liquid crystal display unit. The workstation or personal computer 257 outputs display data having different resolutions and the liquid crystal display unit 258 has means for converting the input display data in accordance with the resolution of its own liquid crystal panel. Here, assume that the workstation or personal computer 257 outputs display data having three resolutions of 1120×780 dots, 1024×768 dots, and 640×480 dots and that the liquid crystal display unit 257 has a liquid crystal panel of a resolution of 1024×768 dots.

Figure 32:
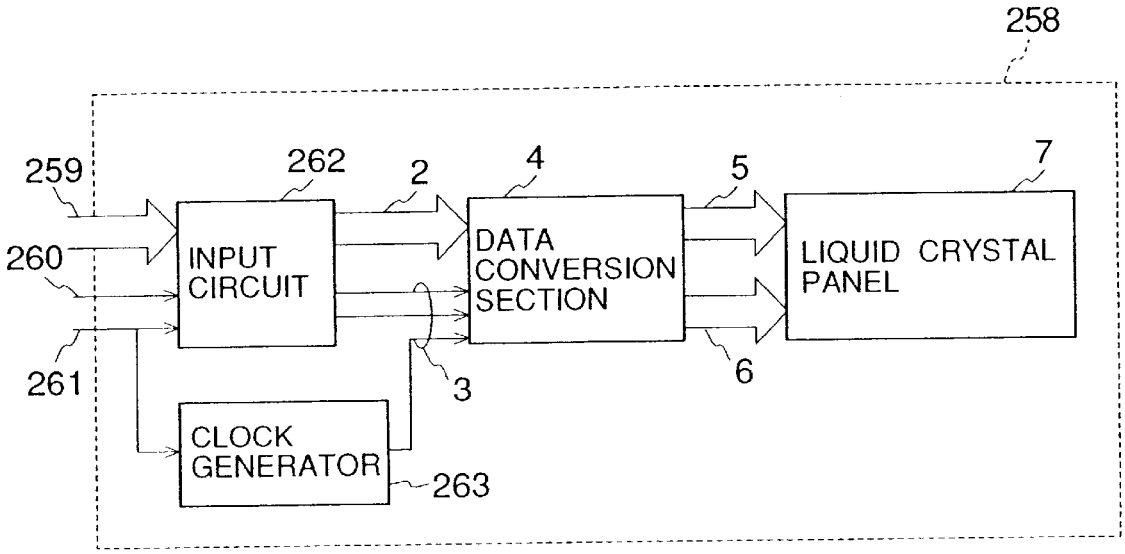
FIG. 32 is a block diagram showing a liquid crystal display unit to which the invention is applied.

FIG. 32 shows the configuration of the liquid crystal display unit 258, wherein numeral 259 indicates PC display data, numeral 260 indicates a PC vertical synchronizing signal, numeral 261 indicates a PC horizontal synchronizing signal, and numeral 262 indicates an input circuit. The input circuit 262 converts an input signal into a TTL level. For example, if the input signal is at ECL level, the input circuit 262 converts the ECL level into TTL level; if the input signal is an analog signal, the input circuit 262 converts the analog signal into digital form; if the input signal is at TTL level, the input circuit 262 serves as a buffer. Numeral 263 indicates a clock generator which generates a liquid crystal display clock, one of liquid crystal timing signals synchronized with the PC display data 259 from the PC horizontal synchronizing signal 261. Numeral 4 indicates a data conversion section which operates as the data conversion section 4 described above, and here determines the resolution of the PC display data 259 from the liquid crystal timing signal 3 and executes reduction process when the resolution is 1120×780 dots, outputs the PC display data as it is when the resolution is 1024×768 dots, or executes enlargement process when 640×480 dots.

We have discussed the enlargement/reduction techniques as execution of the enlargement or reduction process so that the display data output from the PC 1 is made the same as the liquid crystal panel in resolution directly, but a technique of step-by-step execution of enlargement or reduction process may be used as described above.

Thus, display data can be displayed on a panel having a different resolution by enlarging or reducing the display data using algorithms of generating 32-pixel data from 35-pixel data, 15-pixel data from 16-pixel data, 7-pixel data from 8-pixel data, 8-pixel data from 5-pixel data, etc.

As described above, operations are performed on gradation information on a plurality of pixels or dots and display data is enlarged or reduced according to the result, whereby even display data output by the personal computer system assuming an output device having resolution different from that of the liquid crystal display can be displayed without erasing thin lines or deforming characters and without impairing display information of the resolution before enlargement or reduction. That is, a liquid crystal display system which enables multi-scanning display can be provided.

Considering the current state in which a large number of software products are already distributed, the system can eliminate the need for correcting a large number of software products so as to output signals matched with the resolution of a liquid crystal display from a computer to enable multi-scanning; an inexpensive system can be provided.

What is claimed is:

1. An information processing device that converts a resolution of display data in accordance with a resolution of a display panel, the information processing device comprising:

a lateral direction data conversion unit that enlarges and converts display data corresponding to a number of pixels in a lateral direction of the display data into display data corresponding to a number of pixels in a lateral direction of the display panel; and a longitudinal direction data conversion unit that enlarges and converts display data corresponding to a number of lines in a longitudinal direction of the display data into display data corresponding to a number of lines in a longitudinal direction of the display panel;

wherein the lateral direction data conversion unit enlarges and converts display data of groups of M pixels in the lateral direction of the display data into display data of groups of N pixels in the lateral direction of the display panel;

wherein display data of each of the groups of M pixels is enlarged and converted into display data of a respective one of the groups of N pixels;

wherein N/M is a fraction obtained by reducing to lowest terms a fraction obtained by dividing a total number of pixels in the lateral direction of the display panel by a total number of pixels in the lateral direction of the display data;

wherein each of the M pixels is divided into N equal parts; wherein each of the N equal parts of each of the M pixels is assigned to one of the N pixels; and wherein the display data of each one of the N pixels is obtained by multiplying the display data of each of the M pixels having at least one N equal part assigned to the one N pixel by a number of the N equal parts of the M pixel assigned to the one N pixel to obtain a contribution to the display data of the one N pixel from the M pixel, adding up the contributions to the one N pixel from all of the M pixels having at least one N equal part assigned to the one N pixel to obtain a total contribution, and dividing the total contribution by M to obtain the display data of the one N pixel.

2. An information processing device according to claim 1, wherein the longitudinal direction data conversion unit includes:

a longitudinal direction operation unit that generates display data of a plurality of intermediate lines, each of the intermediate lines being between a respective set of two longitudinally contiguous lines of the display data and being generated based on display data of the two longitudinally contiguous lines; and a selector that inserts each of the intermediate lines between the two longitudinally contiguous lines in the respective set of two longitudinally contiguous lines.

3. An information processing device according to claim 1, wherein the information processing device converts a resolution of 640 pixels×480 lines to a resolution of 1024 pixels×768 lines.

4. An information processing device according to claim 1, further comprising the display panel.

5. An information processing device according to claim 1, further comprising a timing signal generation unit that generates a display timing signal for displaying display data on the display panel, the display data to be displayed on the display panel having been enlarged and converted in accordance with the resolution of the display panel by at least one of the lateral direction data conversion unit and the longitudinal direction data conversion unit.

6. An information processing device according to claim 1, wherein each of the lateral direction data conversion unit and the longitudinal direction data conversion unit enlarge and convert RGB display data by separately enlarging and converting each of R display data, G display data, and B display data.

* * * * *